US006224348B1

(12) United States Patent
Fukanuma et al.

(10) Patent No.: US 6,224,348 B1
(45) Date of Patent: May 1, 2001

(54) DEVICE AND METHOD FOR CONTROLLING DISPLACEMENT OF VARIABLE DISPLACEMENT COMPRESSOR

(75) Inventors: Tetsuhiko Fukanuma; Masahiro Kawaguchi, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/494,692

(22) Filed: Jan. 31, 2000

(30) Foreign Application Priority Data

Feb. 1, 1999 (JP) ..... 11-023780
Mar. 23, 1999 (JP) ..... 11-078163

(51) Int. Cl.[7] ..... F04B 1/26
(52) U.S. Cl. ..... 417/222.2; 251/129.13
(58) Field of Search ..... 417/222.1, 222.2; 251/129.13

(56) References Cited

U.S. PATENT DOCUMENTS 4,780,059 * 10/1988 Taguchi ..... 417/222.2
4,815,943 * 3/1989 Kawashima et al. ..... 417/222.2
4,932,843 * 6/1990 Itoigawa et al. ..... 417/222.1
4,960,367 * 10/1990 Terauchi ..... 417/222.2
4,979,877 * 12/1990 Shimizu ..... 417/222.2
5,145,325 * 9/1992 Terauchi ..... 417/222.2
5,865,604 2/1999 Kawaguchi et al. ..... 417/222.2
5,890,876 4/1999 Suito et al. ..... 417/222.2
5,964,578 * 10/1999 Suitou ..... 417/222.2
6,036,447 * 3/2000 Kawaguchi et al. ..... 417/222.2
6,062,823 * 5/2000 Kawaguchi et al. ..... 417/222.2
6,062,824 * 5/2000 Kimura et al. ..... 417/222.2
6,146,106 * 11/2000 Suitou et al. ..... 417/222.2

FOREIGN PATENT DOCUMENTS 8-338364 12/1996 (JP) .

* cited by examiner

*Primary Examiner*—Teresa Walberg
*Assistant Examiner*—Leonid Fastovsky
(74) *Attorney, Agent, or Firm*—Morgan & Finnegan, LLP

(57) ABSTRACT

A variable displacement compressor includes a swash plate and a displacement control valve. The swash plate is moved between a maximum inclination position and a minimum inclination position in accordance with the pressure in a crank chamber. The control valve changes the crank chamber pressure to change the swash plate inclination. The control valve includes a valve body and an electromagnetic actuator for moving the valve body. Movement of the valve body is controlled according to current supplied to the actuator. The control valve also includes a fluid damper for applying fluid resistance to the valve body. The fluid resistance prevents the valve body from moving too quickly. The fluid damper therefore prevents the crank chamber pressure from being suddenly changed. Also, the fluid damper prevents the swash plate inclination from being suddenly changed. Instead of using the fluid damper, the sudden movement of the valve body may be prevented by controlling current supplied to the electromagnetic actuator.

21 Claims, 12 Drawing Sheets

S1
S2
Time suction pressure
P1
P2
P3
P4
P5
P6
Time

Supply current value
Maximum value
Ix
Iy
0
E1
E1'
E2
E2'
Time

Swash plate inclination
Maximum
Minimum
K1
K2
Time

S1
S2
Time suction pressure
Q1
Q2
Q3
Q4
Q5
Q6
Time

Supply current value
Maximum value
Ix
Iy
Iw
Iz
0
D1
D2
D3
D4
Time

Swash plate inclination
Maximum
Minimum
H1
H2
Time

S3
S4
Time suction pressure
R1
R2
Time

Supply current value
Maximum value
F1
F2
0
Time

Swash plate inclination
Maximum
G1
G2
Minimum
Time

DEVICE AND METHOD FOR CONTROLLING DISPLACEMENT OF VARIABLE DISPLACEMENT COMPRESSOR

BACKGROUND OF THE INVENTION

The present invention relates to a variable displacement compressor used in vehicle air conditioners. Specifically, the present invention pertains to a device and a method for controlling the displacement of a variable displacement compressor.

FIG. 14 shows a prior art variable displacement compressor. The compressor includes a housing 101. A crank chamber 102 is defined in the housing 101. A drive shaft 103 is rotatably supported in the housing 101. A lip seal 104 is located between the housing 101 and the drive shaft 103 to prevent gas leakage along the surface of the drive shaft 103.

The drive shaft 103 is connected to a vehicle engine Eg, which serves as an external power source, through an electromagnetic friction clutch 105. The friction clutch 105 includes a pulley 106, an armature 107 and an electromagnetic coil 108. When the clutch 105 engages, that is, when the coil 108 is excited, the armature 107 is attracted to and is pressed against the pulley 106. As a result, the clutch 105 transmits the driving force of the engine Eg to the drive shaft 103.

When the clutch 105 disengages, that is, when the coil 108 is de-excited, the armature 107 is separated from the pulley 106. In this state, the driving force of the engine Eg is not transmitted to the drive shaft 103.

A rotor 109 is secured to the drive shaft 103 in the crank chamber 102. A thrust bearing 122 is located between the rotor 109 and the inner wall of the housing 101. A swash plate 110 is coupled to the rotor 109 by a hinge mechanism 111. The hinge mechanism 111 permits the swash plate 110 to rotate integrally with the drive shaft 103 and to incline with respect to the axis L of the drive shaft 103. When the swash plate 110 abuts against a limit ring 112 fitted about the drive shaft 103 as illustrated by two-dot chain line in FIG. 14, the swash plate 110 is at the minimum inclination position. When the swash plate 110 abuts against the rotor 109 as illustrated by solid line in FIG. 14, the swash plate 110 is at the maximum inclination position.

Cylinder bores 113, suction chamber 114 and a discharge chamber 115 are defined in the housing 101. A piston 116 is reciprocally housed in each cylinder bore 113. The pistons 116 are coupled to the swash plate 110. The housing 101 includes a valve plate 117. The valve plate 117 separates the cylinder bores 113 from the suction chamber 114 and the discharge chamber 115.

Rotation of the drive shaft 103 is converted into reciprocation of each piston 116 by the rotor 109, the hinge mechanism 111 and the swash plate 110. Reciprocation of each piston 116 draws refrigerant gas from the suction chamber 114 to the corresponding cylinder bore 113 via a suction port 117*a* and a suction valve flap 117*b*, which are formed in the valve plate 117. Refrigerant gas in the cylinder bore 113 is compressed to reach a predetermined pressure and is discharged to the discharge chamber 115 via a discharge port 117*c* and a discharge valve flap 117*d*, which are formed in the valve plate 117.

A spring 118 urges the drive shaft 103 forward (to the left as viewed in FIG. 14) along the axis L through a thrust bearing 123. The spring 118 prevents axial chattering of the drive shaft 103.

The crank chamber 102 is connected to the suction chamber 114 by a bleeding passage 119. The discharge chamber 115 is connected to the crank chamber 102 by a supply passage 120. The opening of the supply passage 120 is regulated by an electromagnetic displacement control valve 121.

The control valve 121 adjusts the opening of the supply passage 120 thereby regulating the amount of pressurized refrigerant gas drawn into the crank chamber 102 from the discharge chamber 115. The pressure in the crank chamber 102 is changed, accordingly. As a result, the inclination of the swash plate 110 is altered and the stroke of each piston 116 is changed, which varies the compressor displacement.

When the clutch 105 disengages or when the engine Eg is stops, the control valve 121 fully opens the supply passage 120. This increases the pressure in the crank chamber 102 and decreases the inclination of the swash plate 110. The compressor stops operating with the swash plate 110 at the minimum inclination position. When the compressor is started again, the displacement of the compressor is minimum, which requires minimum torque. The shock caused by starting the compressor is thus reduced.

When there is a relatively great cooling demand on a refrigeration circuit that includes the compressor of FIG. 14, for example, when the temperature in a passenger compartment of a vehicle is much higher than a target temperature set in advance, the control valve 121 closes the supply passage 120 and maximizes the compressor displacement.

When the clutch 105 disengages or when the engine Eg is stopped, the compressor is stopped. If the compressor is stopped when operating at the maximum displacement, the control valve 121 quickly and fully opens the closed supply passage 120. Also, when the vehicle is suddenly accelerated while the compressor is operating at the maximum displacement, the control valve 121 quickly and fully opens the supply passage 120 to minimize the displacement to reduce the load applied to the engine.

Accordingly, highly pressurized refrigerant gas in the discharge chamber 115 is quickly supplied to the crank chamber 102, which rapidly increases the pressure in the crank chamber 102. Refrigerant gas in the crank chamber 102 constantly flows to the suction chamber 114 through the bleeding passage 119. However, since the amount of refrigerant gas that flows to the suction chamber 114 through the bleeding passage 119 is limited, the pressure in the crank chamber 102 is quickly increased an excessive level.

The sudden increase of the crank chamber pressure suddenly moves the swash plate 110 from the maximum inclination position to the minimum inclination position, which causes the swash plate 110 violently collides with the limit ring 112. The collision produces unpleasant noise. The swash plate 110 also strongly pulls the drive shaft 103 rearward (to the right as viewed in FIG. 14) through the ring 112 or through the hinge mechanism 111 and the rotor 109. As a result, the drive shaft 103 moves rearward along the axis L against the force of the spring 118.

When the drive shaft 103 moves rearward, the axial position of the drive shaft 103 relative to the lip seal 104, which is retained in the housing 101, changes. Normally, a predetermined annular area of the drive shaft 103 contacts the lip seal 104. Foreign particles and sludge adhere to a surface of the drive shaft 103 that is axially adjacent to the predetermined annular area. Therefore, if the axial position of the drive shaft 103 relative to the lip seal 104 changes, sludge enters between the lip seal 104 and the drive shaft 103. This lowers the effectiveness of the lip seal 104 and results in gas leakage from the crank chamber 102.

Particularly, when the drive shaft 103 moves rearward due to disengagement of the clutch 105, the armature 107, which is fixed to the drive shaft 103, moves toward the pulley 106. The clearance between the pulley 106 and the armature 107 is as small as 0.5 mm when the clutch 105 disengages. Rearward movement of the drive shaft 103 eliminates the clearance between the pulley 106 and the armature 107, which may cause the armature 107 to contact the rotating pulley 106. As a result, noise and vibration are produced. Also, even if the clutch 105 disengages, the driving force of the engine Eg is transmitted to the drive shaft 103.

When the drive shaft 103 moves rearward, the average position of the pistons 116, which are coupled to the drive shaft 103 by the swash plate 110, is moved rearward. This causes the top dead center of each piston 116 to approach the valve plate 117. If the compressor is operating, the pistons 116 may repeatedly collide with the valve plate 117, which produces vibration and noise.

To prevent the drive shaft 103 from moving rearward, the force of the spring 118 may be set greater. However, a greater force of the spring 118 increases load acting on the thrust bearings 122, 123 and increases power loss of the compressor.

If the compressor starts operating by engagement of the clutch 105 when there is a relatively great cooling demand on a refrigeration circuit that includes the compressor of FIG. 14, the control valve 121 suddenly closes the fully opened supply passage 120 to maximize the compressor displacement. Accordingly, the swash plate 110 moves from the minimum inclination position to the maximum inclination position and violently collides with the rotor 109. The collision produces unpleasant noise.

Japanese Unexamined Patent Publication No. 8-338364 also discloses a variable displacement compressor that has similar drawbacks as the compressor of FIG. 14.

SUMMARY OF THE INVENTION

Accordingly, it is an objective of the present invention to provide displacement control device and method for variable displacement compressors that prevent crank chamber pressure from being excessively increased.

Another objective of the present invention is to provide displacement control device and method for variable displacement compressors that prevent a swash plate from violently colliding with other parts in the compressor.

To achieve the foregoing and other objectives and in accordance with the purpose of the present invention, a compressor having a damping device is provided. The compressor includes a housing, a cylinder bore formed in the housing, a control pressure chamber defined in the housing and a piston housed in the cylinder bore. The piston compresses gas drawn into the cylinder bore and discharges the gas from the cylinder bore. The compressor further includes a drive shaft, a drive plate and a control valve. The drive shaft is rotatably supported by the housing. The drive plate is operably coupled to the piston to convert rotation of the drive shaft into reciprocation of the piston. The drive plate is supported by the drive shaft to incline relative to the drive shaft and is moved between a maximum inclination position and a minimum inclination position in accordance with the pressure in the control pressure chamber. The inclination of the drive plate defines the stroke of the piston and the displacement of the compressor. The control valve controls the pressure in the control pressure chamber to change the inclination of the drive plate. The control valve is actuated based on an electrical signal. The damping device decreases the speed of operation of the control valve.

The present invention may also be embodied as a method for controlling the displacement of a variable displacement compressor. The method includes: controlling the pressure in the control pressure chamber by a control valve to change the inclination of the drive plate, wherein the control valve includes a valve body and an electromagnetic actuator for moving the valve body; controlling current supplied to the electromagnetic actuator, wherein movement of the valve body is controlled in accordance with current supplied to the electromagnetic actuator; and preventing the valve body from being suddenly moved, wherein, when the value of current supplied to the electromagnetic actuator is changed from a first value to a second value, sudden movement of the valve body is prevented by gradually changing the value of the current in at least a part of the range between a first value and a second value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor according to a first embodiment of the present invention will now be described with reference to FIGS. 1 to 5. The compressor is used in a vehicle air conditioner.

Figure 1:
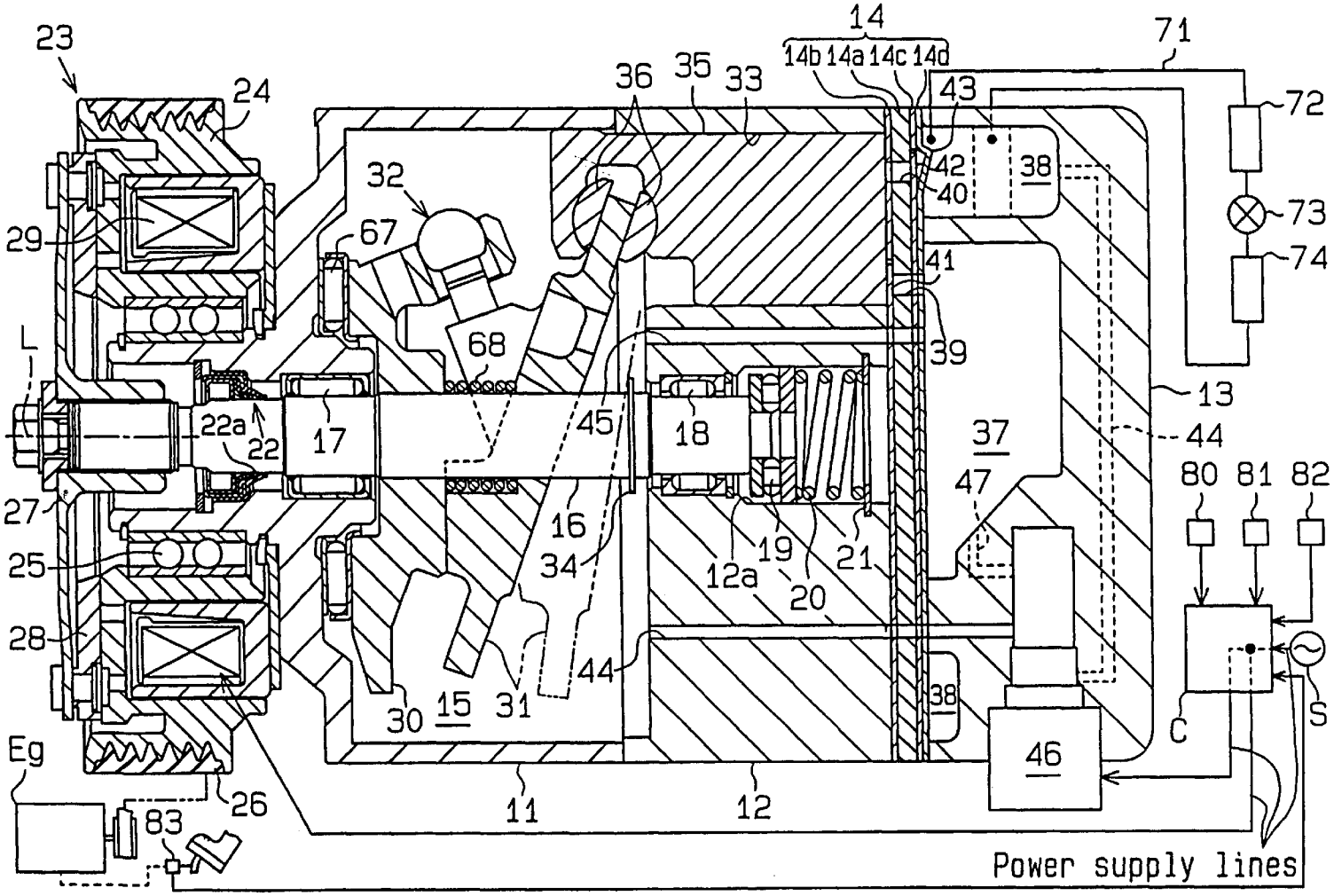
FIG. 1 is a cross-sectional view illustrating a variable displacement compressor according to a first embodiment of the present invention.

As shown in FIG. 1, a front housing 11 is secured to the front end face of a center housing, which is a cylinder block 12 in this embodiment. A rear housing 13 is secured to the rear end face of the cylinder block 12, and a valve plate assembly 14 is located between the rear housing 13 and the rear end face. The front housing 11, the cylinder block 12, the rear housing 13 form the compressor housing. The left in FIG. 1 is defined as the front side of the compressor and the right in FIG. 1 is defined as the rear side of the compressor.

The valve plate assembly 14 includes a main plate 14*a*, a first sub-plate 14*b*, a second sub-plate 14*c*, and a retainer plate 14*d*. The main plate 14*a* is located between the first sub-plate 14*b* and the second sub-plate 14*c*. The retainer plate 14*d* is located between the second sub-plate 14*c* and the rear housing member 13.

A control pressure chamber, which is a crank chamber 15 in this embodiment, is defined between the front housing 11 and the cylinder block 12. The drive shaft 16 extends through the crank chamber 15 and is rotatably supported by the front housing 11 and the cylinder block 12.

The drive shaft 16 is supported by the front housing 11 via a radial bearing 17. A central bore 12*a* is formed substantially in the center of the cylinder block 12. The rear end of the drive shaft 16 is located in the central bore 12*a* and is supported by the cylinder block 12 via a radial bearing 18. A spring seat 21 is fitted to the wall of the central bore 12*a*. A thrust bearing 19 and a support coil spring 20 are located in the central bore 12*a* to be between the rear end of the drive shaft 16 and the spring seat 21. The support spring 20, or urging means, urges the drive shaft 16 forward along the axis L of the drive shaft 16 through the thrust bearing 19. The thrust bearing 19 prevents rotation of the drive shaft 16 from being transmitted to the support spring 20.

The front end of the drive shaft 16 projects from the front end of the front housing 11. A shaft sealing assembly, which is a lip seal 22 in this embodiment, is located between the drive shaft 16 and the front housing 11 to prevent leakage of refrigerant gas along the surface of the drive shaft 16. The lip seal 22 includes a lip ring 22*a*, which is pressed against the surface of the drive shaft 16.

An electromagnetic friction clutch 23 is located between an external power source, which is an engine Eg in this embodiment, and the drive shaft 16. The clutch 23 selectively transmits power from the engine Eg to the drive shaft 16. The clutch 23 includes a pulley 24, a hub 27, an armature 28, and an electromagnetic coil 29. The pulley 24 is rotatably supported by the front end of the front housing 11 via an angular bearing 25. A belt 26 is engaged with the pulley 24 to transmit power from the engine Eg to the pulley 24. The hub 27, which has elasticity, is fixed to the front end of the drive shaft 16 and supports the armature 28. The armature 28 is arranged to face the pulley 24. The electromagnetic coil 29 is supported by the front wall of the front housing 11 to face the armature 28.

Figure 4:
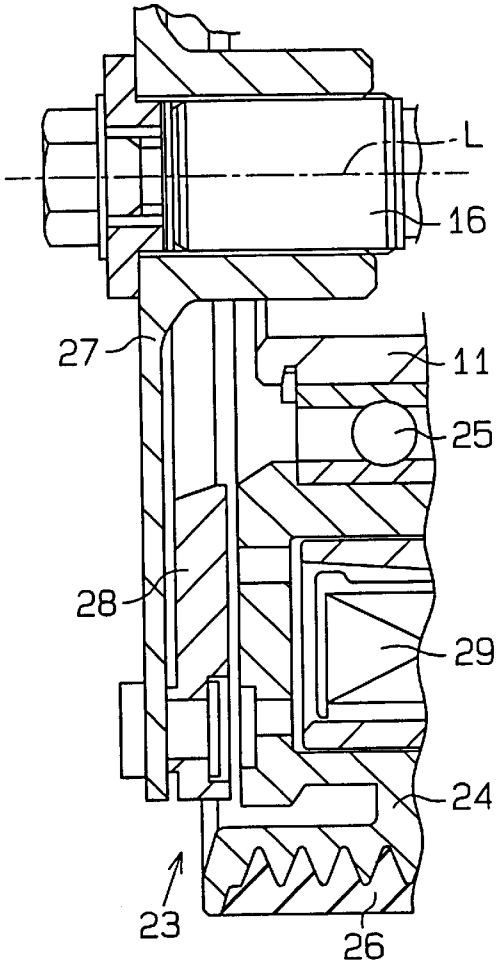
FIG. 4 is an enlarged partial cross-sectional view illustrating the clutch of FIG. 1 when it is disengaged.

When the coil 29 is excited while the engine Eg is running, an attraction force based on electromagnetic force is generated between the armature 28 and the pulley 24. Accordingly, the armature 28 contacts the pulley 24 against the force of the hub 27, which engages the clutch 23. When the clutch 23 is engaged, power from the engine Eg is transmitted to the drive shaft 16 via the belt 26 and the clutch 23 (See FIG. 1). When the coil 29 is de-excited in this state, the armature 28 is separated from the pulley 24 by the force of the hub 27 as shown in FIG. 4, which disengages the clutch 23. When the clutch 23 is disengaged, transmission of power from the engine Eg to the drive shaft 16 is disconnected.

As shown in FIG. 1, a rotor 30 is fixed to the drive shaft 16 in the crank chamber 15. A thrust bearing 67 is located between the rotor 30 and the inner wall of the front housing 11. A drive plate, which is a swash plate 31 in this embodiment, is supported on the drive shaft 16 to slide axially and to incline with respect to the axis L of the drive shaft 16. A hinge mechanism 32 is located between the rotor 30 and the swash plate 31. The swash plate 31 is coupled to the rotor 30 via the hinge mechanism 32. The hinge mechanism 32 rotates the swash plate 31 integrally with the rotor 30. The hinge mechanism 32 also guides the swash plate 31 to slide along and incline with respect to the drive shaft 16.

A coil spring 68 is fitted about the drive shaft 16 and is located between the rotor 30 and the swash plate 31. The coil spring 68 urges the swash plate 31 in a direction decreasing the inclination of the swash plate 31.

A limit ring 34 is attached to the drive shaft 16 between the swash plate 31 and the cylinder block 12. As shown by the broken line in FIG. 1, the inclination of the swash plate 31 is minimized when the swash plate 31 abuts against the limit ring 34. On the other hand, as shown by solid lines in FIG. 1, the inclination of the swash plate 31 is maximized when the swash plate 31 abuts against the rotor 30.

Cylinder bores 33 (only one is shown in FIG. 1) are formed in the cylinder block 12. The cylinder bores 33 are arranged at equal angular intervals about the axis L of the drive shaft 16. A single headed piston 35 is accommodated in each cylinder bore 33. Each piston 35 is coupled to the swash plate 31 via a pair of shoes 36. The swash plate 31 converts rotation of the drive shaft 16 into reciprocation of the pistons 35.

A suction pressure zone, which is a suction chamber 37 in this embodiment, is defined in the substantial center of the rear housing 13. A discharge pressure zone, which is a discharge chamber 38 in this embodiment, is formed in the rear housing 13 and surrounds the suction chamber 37. The main plate 14*a* of the valve plate assembly 14 includes suction ports 39 and discharge ports 40, which correspond to each cylinder bore 33. The first sub-plate 14*b* includes the suction valves 41, each of which corresponds to one of the suction ports 39. The second sub-plate 14*c* includes the discharge valves 42, each of which corresponds to one of the discharge ports 40. The retainer plate 14*d* includes retainers 43, which correspond to the discharge valves 42. Each retainer 43 determines the maximum opening size of the corresponding discharge valve flap 42.

When each piston 35 moves from the top dead center position to the bottom dead center position, refrigerant gas in the suction chamber 37 flows into the corresponding cylinder bore 33 via the corresponding suction port 39 and suction valve flap 41. When each piston 35 moves from the bottom dead center position to the top dead center position, refrigerant gas in the corresponding cylinder bore 33 is compressed to a predetermined pressure and is discharged to the discharge chamber 38 via the corresponding discharge port 40 and discharge valve flap 42.

A supply passage 44 connects the discharge chamber 38 to the crank chamber 15. A bleeding passage 45 connects the crank chamber 15 to the suction chamber 37. A displacement control valve 46 is located in the supply passage 44. The control valve 46 adjusts the flow rate of refrigerant gas from the discharge chamber 38 to the crank chamber 15 by varying the opening size of the supply passage 44. The pressure in the crank chamber 15 is varied in accordance with the relation between the flow rate of refrigerant gas from the discharge chamber 38 to the crank chamber 15 and that from the crank chamber 15 to the suction chamber 37 through the bleeding passage 45. Accordingly, the difference between the pressure in the crank chamber 15 and the pressure in the cylinder bores 33 is varied, which changes the inclination of the swash plate 31. This alters the stroke of each piston 35 and the displacement.

Figure 2:
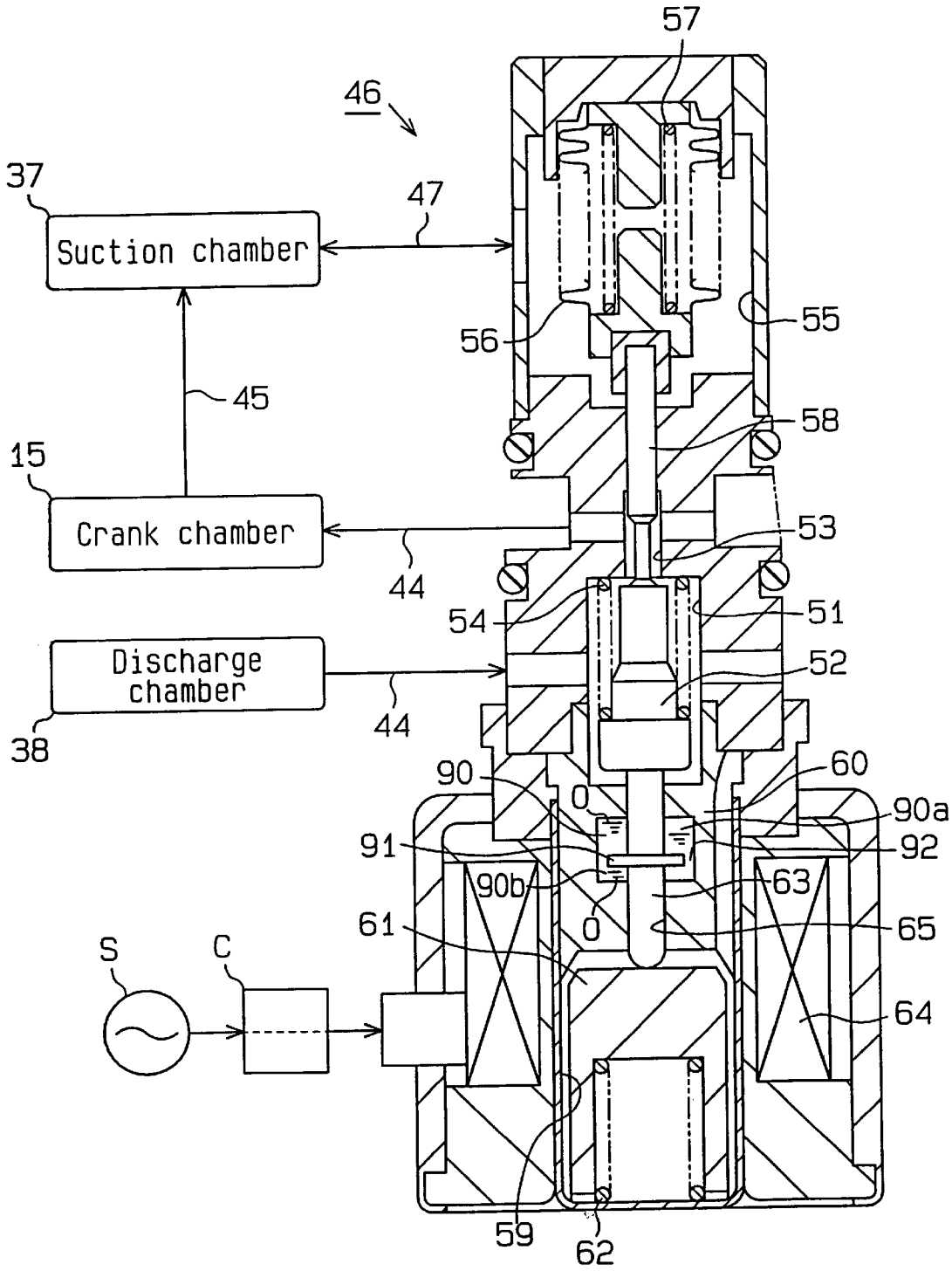
FIG. 2 is an enlarged cross-sectional view illustrating the displacement control valve used in the compressor of FIG. 1.

A control valve 46 will now be described. As shown in FIG. 2, a valve chamber 51 is defined in the substantial center of the control valve 46. A valve body 52 is accommodated in the valve chamber 51. An opening of a valve hole 53 in the valve chamber 51 faces the valve body 52. The valve chamber 51 and the valve hole 53 form part of the supply passage 44. A spring 54 is located in the valve chamber 51 between the wall and the valve body 52 to urge the valve body 52 in a direction opening the valve hole 53.

A pressure sensing chamber 55 is located above the valve chamber 51. The pressure sensing chamber 55 is connected to the suction chamber 37 by a pressure introduction passage 47. A pressure sensing member, which is a bellows 56 in this embodiment, is accommodated in the pressure sensing chamber 55. A spring 57 is located in the bellows 56. The spring 57 determines the initial length of the bellows 56. A rod 58 extends from the valve body 52 toward the bellows 56 to operably couple the bellows 56 with the valve body 52.

A plunger chamber 59 is located below the valve chamber 51. A fixed iron core 60 is located between the plunger chamber 59 and the valve chamber 51. A plunger, which is a movable iron core 61 in this embodiment, is accommodated in the plunger chamber 59. A follower spring 62 is accommodated in the plunger chamber 59 to urge the movable iron core 61 toward the valve body 52. A guide hole 65 extends through the fixed iron core 60 to communicate the valve chamber 51 with the plunger chamber 59. A solenoid rod 63 extends from the valve body 52 through the guide hole 65. The force of the springs 54, 62 causes the distal end of the solenoid rod 63 to contact the movable iron core 61. Accordingly, the valve body 52 and the movable iron core 61 are operably coupled to each other by the solenoid rod 63.

A coil 64 is located about the fixed iron core 60 and the movable iron core 61. The fixed iron core 60, the movable iron core 61, the coil 64 and the solenoid rod 63 form an electromagnetic actuator for moving the valve body 52.

As shown in FIG. 1, the suction chamber 37 is connected to the discharge chamber 38 through an external refrigerant circuit 71. The external refrigerant circuit 71 includes a condenser 72, an expansion valve 73 and an evaporator 74. The external refrigerant circuit 71 and the compressor form a cooling circuit for a vehicle air conditioner.

An air conditioner switch 80, a passenger compartment temperature sensor 81, a temperature adjuster 82 and an acceleration pedal sensor 83 are connected to a controller C. The pedal sensor 83 detects the degree of depression, or position, of a gas pedal. Power supply wire is connected to the coil 29 of the clutch 23 and the coil 64 of the control valve 46 from a power source S such as a vehicle battery through the controller C.

The controller C includes a computer. The controller C computes a current value supplied to the coils 29, 64 from the power source S based on various conditions including, for example, an ON/OFF signal from the air conditioner switch 80, the passenger compartment temperature detected by the temperature sensor 81, a target temperature set by the temperature adjuster 82 and a pedal depression amount detected by the acceleration pedal sensor 83.

Generally, when the engine Eg is stopped (specifically, when the key switch is turned off), electrical devices of a vehicle are not supplied with electric power. When the engine Eg is stopped, the electric supply wire between the coils 29, 64 and the power source S is disconnected at a part upstream of the controller C, which stops electricity to the coils 29, 64 from the power source S.

The operation of the compressor will now be described. When the engine Eg is running, the controller C supplies current from the power source S to the coil 29 if the air conditioner switch 80 is turned on and the temperature detected by the compartment temperature sensor 81 is greater than a temperature set by the temperature adjuster 82. Accordingly, the clutch 23 is engaged, which starts the compressor.

The controller C determines the value of current supplied to the coil 64 of the control valve 46 based on signals from the compartment temperature sensor 81 and the temperature adjuster 82. The controller C supplies a current having the determined value from the power source S to the coil 64. Accordingly, an electromagnetic attraction force is generated between the fixed iron core 60 and the movable iron core 61. The magnitude of the attraction force corresponds to the value of the received current. The attraction force urges the valve body 52 in a direction decreasing the opening size of the valve hole 53. The bellows 56 of the control valve 46 expands and contracts in accordance with the pressure (suction pressure) introduced to the pressure sensing chamber 55 from the suction chamber 37. The bellows 56 applies a force to the valve body 52 and the magnitude of the force corresponds to the suction pressure in the pressure sensing chamber 55.

Thus, the opening amount of the valve hole 53 is determined based on the force applied to the valve body 52 by the bellows 56, the attraction force between the fixed iron core 60 and the movable iron core 61 and the force of the springs 54, 62.

The controller C increases the value of the current supplied to the coil 64 when there is a greater difference between the detected compartment temperature and the target temperature, or when the cooling circuit is required to operate with a greater refrigerant performance. A greater value of the current increases the magnitude of the attractive force between the fixed core 60 and the movable core 61 thereby increasing the resultant force urging the valve body 52 in a direction closing the valve hole 53. This lowers a target value of the suction pressure. The bellows 56 controls the opening of the valve hole 53 with the valve body 52 such that the suction pressure is maintained at the lowered target value. That is, the control valve 46 adjusts the displacement of the compressor such that the lower suction pressure is maintained when the value of current supplied to the coil 64 is greater.

When the current supplied to the coil 64 is increased, or when the suction pressure increases, the valve body 52 decreases the opening amount of the valve hole 53. This decreases the amount of refrigerant gas supplied to the crank chamber 15 from the discharge chamber 38. Since refrigerant gas in the crank chamber 15 is constantly conducted to the suction chamber 37, the crank chamber pressure is gradually lowered. This increases the inclination of the swash plate 31, thereby causing the compressor to operate at a larger displacement. A larger compressor displacement increases the cooling performance of the cooling circuit and lowers the suction pressure.

The controller C decreases the value of the current supplied to the coil 64 when there is a smaller difference between the detected compartment temperature and the target temperature, or when the cooling circuit is required to operate with a smaller refrigerant performance. A smaller value of the current decreases the magnitude of the attractive force between the fixed core 60 and the movable core 61 thereby decreasing the resultant force urging the valve body 52 in a direction closing the valve hole 53. This raises a target value of the suction pressure. The bellows 56 controls the opening of the valve hole 53 with the valve body 52 such that the suction pressure is maintained at the raised target value. That is, the control valve 46 adjusts the displacement of the compressor such that a higher suction pressure is maintained when the value of current supplied to the coil 64 is smaller.

When the current value to the coil 64 is decreased, or when the suction pressure is lowered, the valve body 52 increases the opening amount of the valve hole 53. This increases the amount of refrigerant gas supplied to the crank chamber 15 from the discharge chamber 38. If the amount of refrigerant gas supplied from the discharge chamber 38 to the crank chamber 15 is greater than the amount of refrigerant gas released from the crank chamber 15 to the suction chamber 37, the crank chamber pressure 15 gradually increases. This decreases the inclination of the swash plate 31, thereby causing the compressor to operate at a smaller displacement. A smaller compressor displacement decreases the cooling performance of the cooling circuit and raises the suction pressure.

The characteristic structure of the above compressor will now be described.

Figure 3:
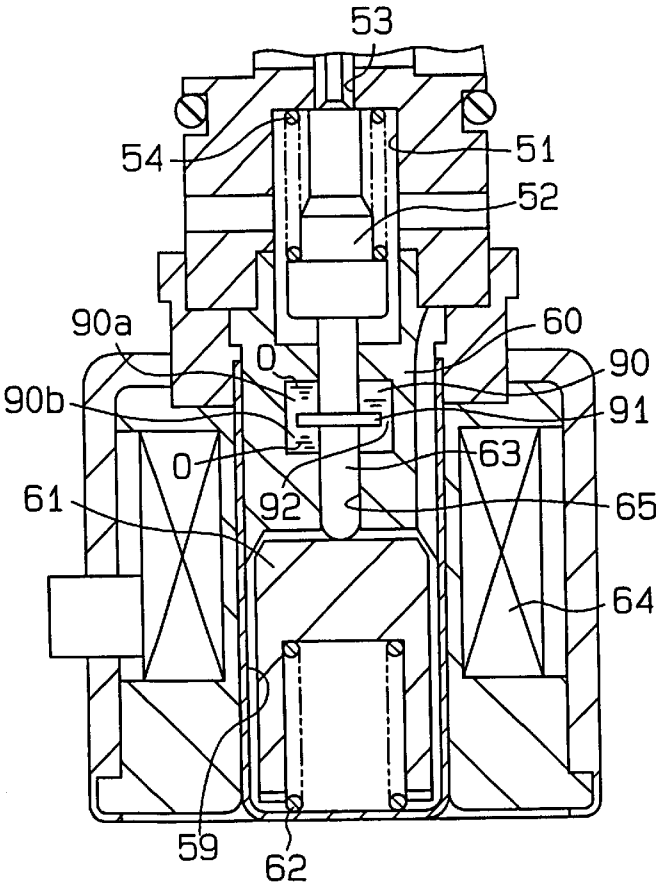
FIG. 3 is an enlarged partial cross-sectional view illustrating the displacement control valve of FIG. 2 when a valve hole is closed.

One of the characteristics is that the control valve 46 includes a damping device. That is, as shown in FIGS. 2 and 3, a damper chamber 90 is formed in the fixed core 60 and is located in the guide hole 65. A fluid, preferably oil O, fills the damper chamber 90. A flange 91 is formed on the solenoid rod 63 at part located in the damper chamber 90. The flange 91 functions as a resistor or as a pressure receiver. The flange 91 divides the damper chamber 90 into a first fluid chamber 90*a* and a second fluid chamber 90*b*. The outer diameter of the flange 91 is slightly smaller than the inner diameter of the damper chamber 90. Therefore, a passage 92 is defined between the flange 91 and the wall of the damper chamber 90. The passage 92 communicates the fluid chambers 90*a*, 90*b* with each other.

The solenoid rod 63 moves in a direction from the state of FIG. 2 to the state of FIG. 3 or in the reverse direction relative to the fixed core 60, the flange 91 changes the volume ratio between the fluid chambers 90*a*, 90*b*. As a result, the oil O flows through the passage 92 between the fluid chambers 90*a*, 90*b*. The flow resistance of the oil O generated in the passage 92 acts on the solenoid rod 63. That is, the damping device, which includes the damper chamber 90, the flange 91 and the passage 92, applies resistance to the solenoid rod 63 to prevent the valve body 52 from being quickly moved.

The operation of the damping device will now be described.

When wishing to quickly accelerate the vehicle, a driver depresses the acceleration pedal by a great amount. If the acceleration pedal sensor 83 detects an acceleration depression degree that is greater than a predetermined value while the compressor is operating, the controller C stops supplying current to the coil 64 of the control valve 46 for a predetermined period. Accordingly, there is no attractive force between the fixed core 60 and the movable core 61, which fully opens the supply passage 44. Thus, the inclination of the swash plate 31 is minimized and the compressor displacement is also minimized. As a result, the load on the engine Eg is reduced, which permits the vehicle to be quickly accelerated.

If the air conditioner switch 80 is turned off while the compressor is operating, the controller C stops supplying current to the coil 29 thereby disengaging the clutch 23, which stops the compressor. At the same time, the controller C stops supplying current to the coil 64 of the control valve 46. If the engine Eg is stopped while the compressor is operating, the power supply wire from the power source S to the coils 29, 64 is disconnected at a part upstream of the controller C. Accordingly, the clutch 23 is disengaged and the compressor is stopped.

When the clutch 23 is disengaged or when the engine Eg is stopped, current supply to the coil 64 of the control valve 46 is stopped. At this time, the control valve 46 fully opens the supply passage 44. Therefore, when the compressor is not operating, the inclination of the swash plate 31 is minimum. When the compressor is started again, the displacement of the compressor is minimum, which requires minimum torque. The shock caused by starting the compressor is thus reduced.

If the control valve 46 fully opens the supply passage 44 when the compressor is operating at the maximum displacement, in other words, if the control valve 46 fully opens the supply passage 44 after the supply passage 44 is fully closed, the solenoid rod 63 is moved from the position of FIG. 3 to the position of FIG. 2. Accordingly, the flange 91 changes the volume ratio between the fluid chambers 90*a*, 90*b*. As a result, the oil O flows between the fluid chambers 90*a*, 90*b* through the passage 92. The flow resistance of the oil O generated in the passage 92 acts on the solenoid rod 63 through the flange 91. This prevents the valve body 52, which is fixed to the solenoid rod 63, from being suddenly moved. Thus, the valve body 52 slowly opens the valve hole 53.

Figure 5:
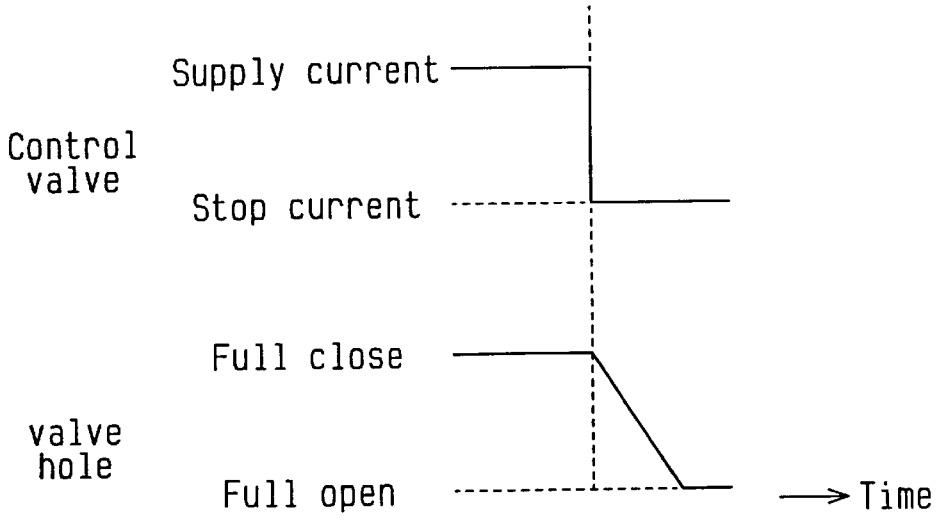
FIG. 5 is a chart showing the operational characteristics of the compressor shown in FIG. 2.

FIG. 5 is a graph showing changes of the opening amount of the valve hole 53 when current supply to the control valve 46 is stopped. As shown in the graph, the current to the control valve 46 is stopped instantaneously. When the current supply to the control valve 46 is stopped, the valve hole 53, which is fully closed, is gradually opened to the fully opened state. This gradual change of the opening amount is caused by the damping device.

Therefore, highly pressurized gas does not suddenly flows to the crank chamber 15 from the discharge chamber 38, which prevents the crank chamber pressure from being suddenly increased. Thus, stopping the current to the control valve 46 does not excessively increase the crank chamber pressure 15.

As a result, the swash plate 31 is not quickly moved from the maximum inclination position to the minimum inclination position. This prevents the swash plate 31 from colliding with the limit ring 34 thereby suppressing noise generated by collision. When at the minimum inclination position, the swash plate 31 does not strongly pulls the drive shaft 16 rearward. The drive shaft 16 is therefore not moved rearward against the force of the support spring 20.

Since the drive shaft 16 is prevented from axially displaced, the drawbacks described in the prior art section, specifically, displacement of the drive shaft 16 relative to the lip seal 22, contact between the armature 28 and the pulley 24 when the clutch 23 is disengaged and collision of the pistons 35 against the valve plate assembly 14, are all resolved.

The control valve 46 controls the amount of highly pressurized gas supplied to the crank chamber 15. Compared to a control valve that controls the amount of gas released from the crank chamber 15, the control valve 46 quickly changes the crank chamber pressure. Accordingly, the inclination of the swash plate 31, or the compressor displacement, is quickly changed. However, from a different point of view, the control valve 46 tends to excessively increase the crank chamber pressure 15 compared to a control valve that controls the amount of gas released from the crank chamber 15. It is therefore very effective to form a damping device in the control valve 46, which controls the amount of highly pressurized refrigerant gas supplied to the crank chamber 15.

The structure of the control valve 46 may be changed such that attractive force generated between the fixed core 60 and the movable core 61 moves the valve body 52 in a direction increasing the opening amount of the valve hole 53. Such change to the control valve 46 does not deviate from the concept of the present invention. If this change is made, the power supply wire between the coil 64 and the power source S must be also modified. Specifically, the power supply wire must not be disconnected at a part upstream of the controller C. If the wire is disconnected at a part upstream of the controller, the compressor displacement is not minimized when the engine Eg is stopped. The modification to the power supply wire requires a major change to the electric system of a conventional vehicle.

However, in the control valve 46, the attractive force between the fixed core 60 and the movable core 61 urges the valve body 52 in a direction decreasing the opening amount of the valve hole 53. Thus, when the engine Eg is stopped, disconnecting the power supply wire between the coil 64 and the power source S at a part upstream of the controller C causes the valve hole 53 to open thereby minimizing the compressor displacement. In other words, the compressor displacement is minimized when the engine Eg is stopped without changing the conventional electric system of a vehicle.

When the air conditioner switch 80 is turned on, the controller C starts supplying current to the coil 29 thereby engaging the clutch 23, which starts the compressor. If there is a relatively great cooling demand on a refrigeration circuit at this time, the controller C starts sending current having a relatively great magnitude to the coil 64 of the control valve 46 at the same time as the air conditioner switch 80 is turned on. Accordingly, the compressor displacement is maximized. The control valve 46 closes the fully opened supply passage 44. That is, the solenoid rod 63 is moved from the position of FIG. 2 to the position of FIG. 3. At this time, the damping device applies resistance to the solenoid rod 63, which prevents the valve body 52 from being quickly moved. The valve body 52 therefore slowly closes the valve hole 53.

Therefore, the swash plate 31 is not suddenly moved from the minimum inclination position to the maximum inclination position. As a result, the swash plate 31 does not violently collide with the rotor 30 and noise due to the collision is not produced.

A second embodiment of the present invention will now be described with reference to FIG. 6. In the second embodiment, the plunger chamber 59 also functions as a damper chamber 90. The plunger chamber 59 is filled with oil O. The movable iron core 61 is located in the plunger chamber 59 and functions as a resistance body or a pressure receiver. In other words, the movable core 61 has the same functions as the flange 91 in the control valve 46 of FIG. 2. The movable core 61 divides the plunger chamber 59 into a first fluid chamber 90*a* and a second fluid chamber 90*b*. The movable core 61 has a passage 92 to communicate the fluid chambers 90*a*, 90*b* with each other.

As the movable core 61 moves axially, the oil O flows between the fluid chambers 90*a*, 90*b*. The flow resistance of the oil O acts on the valve body 52. That is, the oil O applies resistance to the valve body 52 through the movable core 61 and the solenoid rod 63. The valve body 52 is therefore prevented from suddenly moved, which permits the valve body 52 to slowly open or close the valve hole 53.

Figure 6:
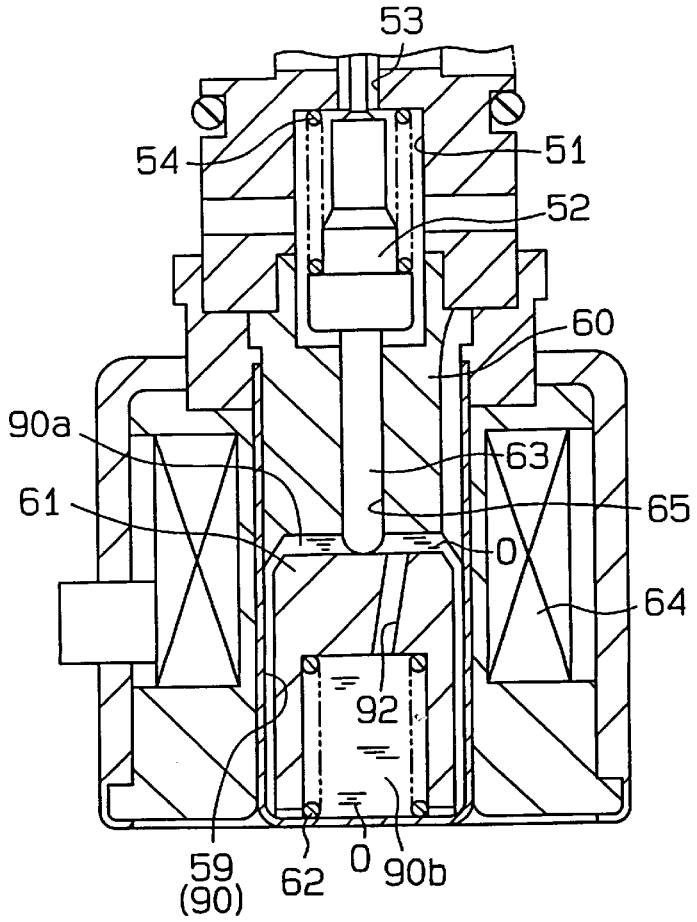
FIG. 6 is an enlarged partial cross-sectional view illustrating a displacement control valve according to a second embodiment of the present invention.

The control valve 46 of FIG. 6 functions in the same manner as that of FIGS. 1 to 5 and has the same advantages. Particularly, in the control valve 46 of FIG. 6, the plunger chamber 59 is used as the damper chamber 90 and the movable core 61 is used as the resistance body (pressure receiver). In other words, the control valve 46 of the second embodiment does not require an exclusive damping device and therefore has a simplified structure.

A third embodiment of the present invention will now be described with reference to FIGS. 7 to 9. The differences from the embodiment of FIGS. 1–5 will mainly be discussed below, and like or the same reference numerals are given to those components that are like or the same as the corresponding components of the embodiment of FIGS. 1 to 5.

Figure 7:
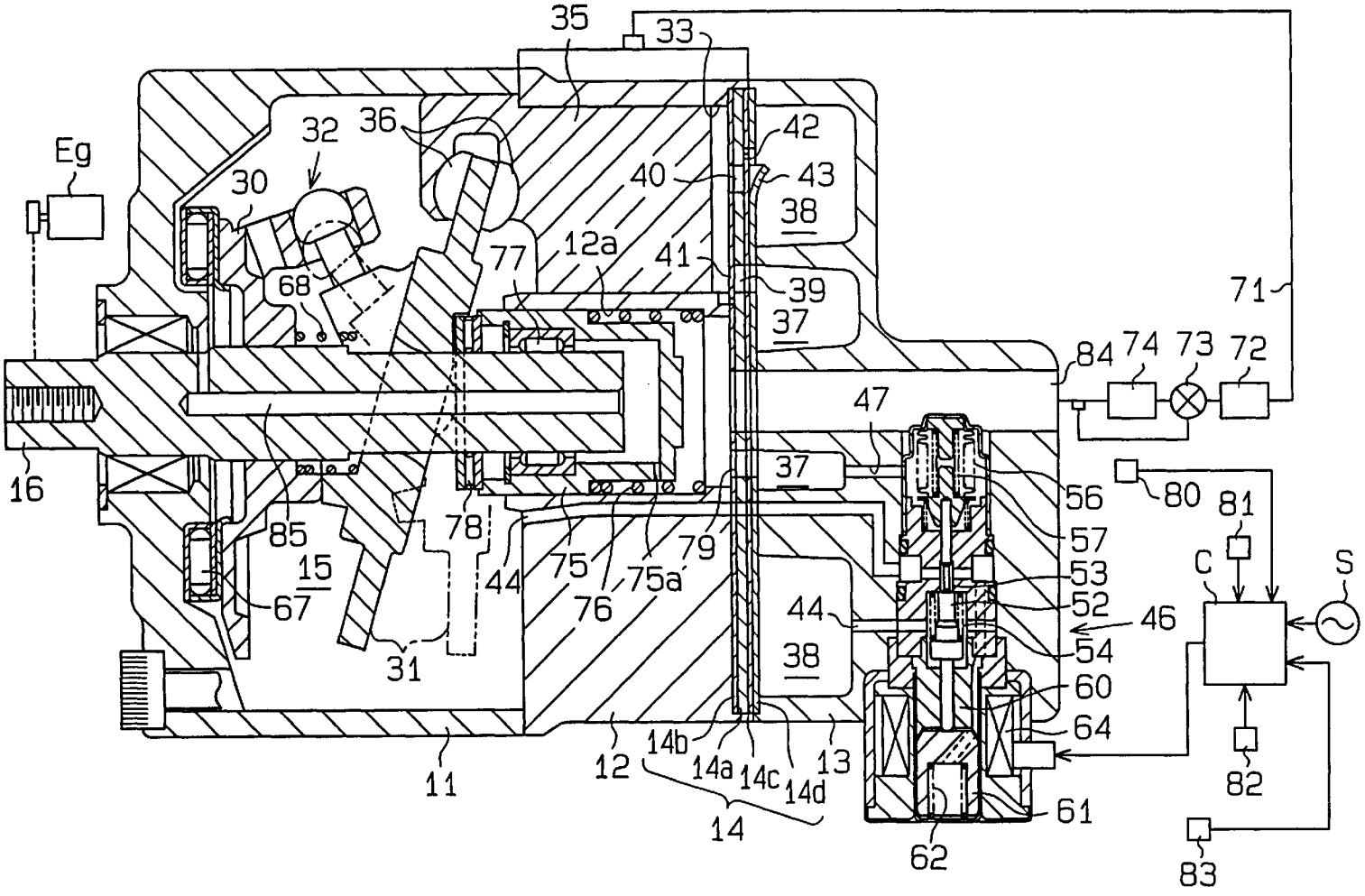
FIG. 7 is a cross-sectional view illustrating a compressor according to a third embodiment of the present invention.
Figure 8:
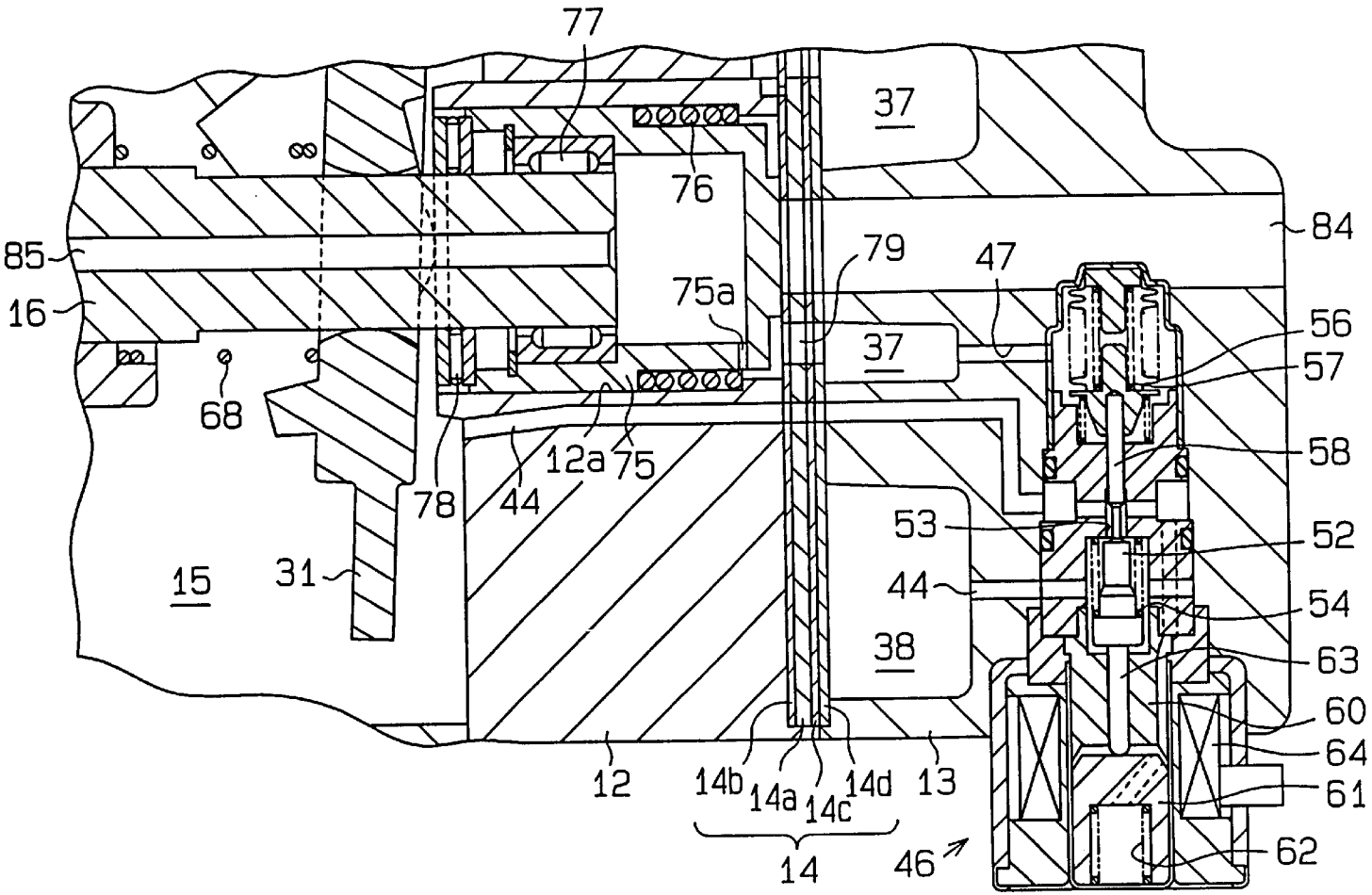
FIG. 8 is an enlarged partial cross-sectional view illustrating the compressor of FIG. 7 when the inclination of the swash plate is maximum.

In the embodiment of FIGS. 7 to 9, sudden movements of the valve body 52 are prevented by controlling current supplied to the control valve 46. As shown in FIGS. 7 and 8, a control valve 46 is substantially the same as the control valve 46 of FIG. 2 except that the control valve 46 does not have the damping device. Unlike the compressor of FIG. 1, the compressor of FIG. 7 does not have an electromagnetic friction clutch. Further, the compressor of FIG. 7 has a mechanism for stopping flow of refrigerant gas into the compressor.

The differences between the compressor of FIG. 1 and the compressor of the third embodiment will now be described. As shown in FIG. 7, the distal end of the drive shaft 16 is directly coupled to the engine Eg without an electromagnetic friction clutch. As shown in FIGS. 7 and 8, a shutter 75 is accommodated in the central bore 12*a*. The shutter 75 slides axially. A spring 76 extends between the shutter 75 and the inner wall of the central bore 12*a*. The spring 76 urges the shutter 75 toward the swash plate 31. The rear end of the drive shaft 16 is supported by the inner wall of the central bore 12*a* through a radial bearing 77 and the shutter 75. The radial bearing 77 permits the shutter 75 and the drive shaft 16 to rotate relative to each other.

A suction passage 84 is formed in the center of the rear housing 13. The suction passage 84 connects the external refrigerant circuit 71 to the central bore 12*a*. When the rear end of the shutter 75 contacts the valve plate assembly 14 as shown in FIG. 8, the suction passage 84 is disconnected from the central bore 12*a*. The shutter 75 cannot be moved further rearward.

A thrust bearing 78 is located between the swash plate 31 and the shutter 75. The swash plate 31 and the shutter 75 are pressed against each other by the springs 68, 75, which permits the swash plate 31 and the shutter 75 move integrally in the axial direction of the drive shaft 16. The thrust bearing 78 prevents rotation of the swash plate 31 from being transmitted to the shutter 75.

The swash plate 31 moves rearward as its inclination decreases. The rearward movement of the swash plate 31 is transmitted to the shutter 75 by the thrust bearing 78. As the swash plate 31 moves rearward, the swash plate 31 pushes the shutter 75 rearward against the force of the spring 76. When the shutter 75 contacts the valve plate assembly 14, the swash plate 31 reaches the minimum inclination.

An axial passage 85 is formed in the drive shaft 16 to connect the crank chamber 15 to the interior of the central bore 12*a*. A pressure release hole 75*a* is formed in the shutter wall near the rear end of the shutter 75 for connecting the interior of the shutter 75 with the central bore 12*a*. The suction chamber 37 is connected with the central bore 12*a* by a communication hole 79 formed in the valve plate assembly 14. The axial passage 85, the pressure release hole 75*a* and the communication hole 79 function as a bleeding passage, which corresponds to the bleeding passage 45 of FIG. 1, for communicating the crank chamber 15 with the suction chamber 37.

When contacting the valve plate assembly 14, the shutter 75 disconnects the hole 79 from the suction passage 84, which stops flow of refrigerant gas from the external refrigerant circuit 71 to the suction chamber 37. In other words, when the swash plate 31 is at the minimum inclination position and the compressor is operating with the minimum displacement, flow of refrigerant from the circuit 71 to the compressor is stopped.

The minimum inclination of the swash plate 31 is slightly more than zero degrees. Therefore, even if the inclination of the swash plate 31, refrigerant gas is discharged from the cylinder bores 33 to the discharge chamber 38. Refrigerant gas discharged to the discharge chamber 38 flows to the crank chamber 15 through the supply passage 44. Refrigerant gas in the crank chamber 15 flows to the suction chamber 37 through the bleeding passage, which includes the axial passage 85, the pressure release hole 75*a* and the hole 79. Refrigerant gas in the suction chamber 37 is drawn into the cylinder bores 33 again. That is, when the inclination of the swash plate 31 is minimum, refrigerant gas circulates within the compressor traveling through the discharge chamber 38, the supply passage 44, the crank chamber 15, the bleeding passage, the suction chamber 37 and the cylinder bores 33. The circulation of refrigerant gas causes lubricant oil contained in the gas to lubricate the moving parts of the compressor.

When the inclination of the swash plate 31 is greater than the minimum inclination, the shutter 75 is separated from the valve plate assembly 14, which permits refrigerant gas to flow from the external refrigerant circuit 71 to the suction chamber 37 through the suction passage 84. Accordingly, refrigerant starts circulating between the circuit 71 and the compressor.

Figures 9A, 9B, 9C, 9D:
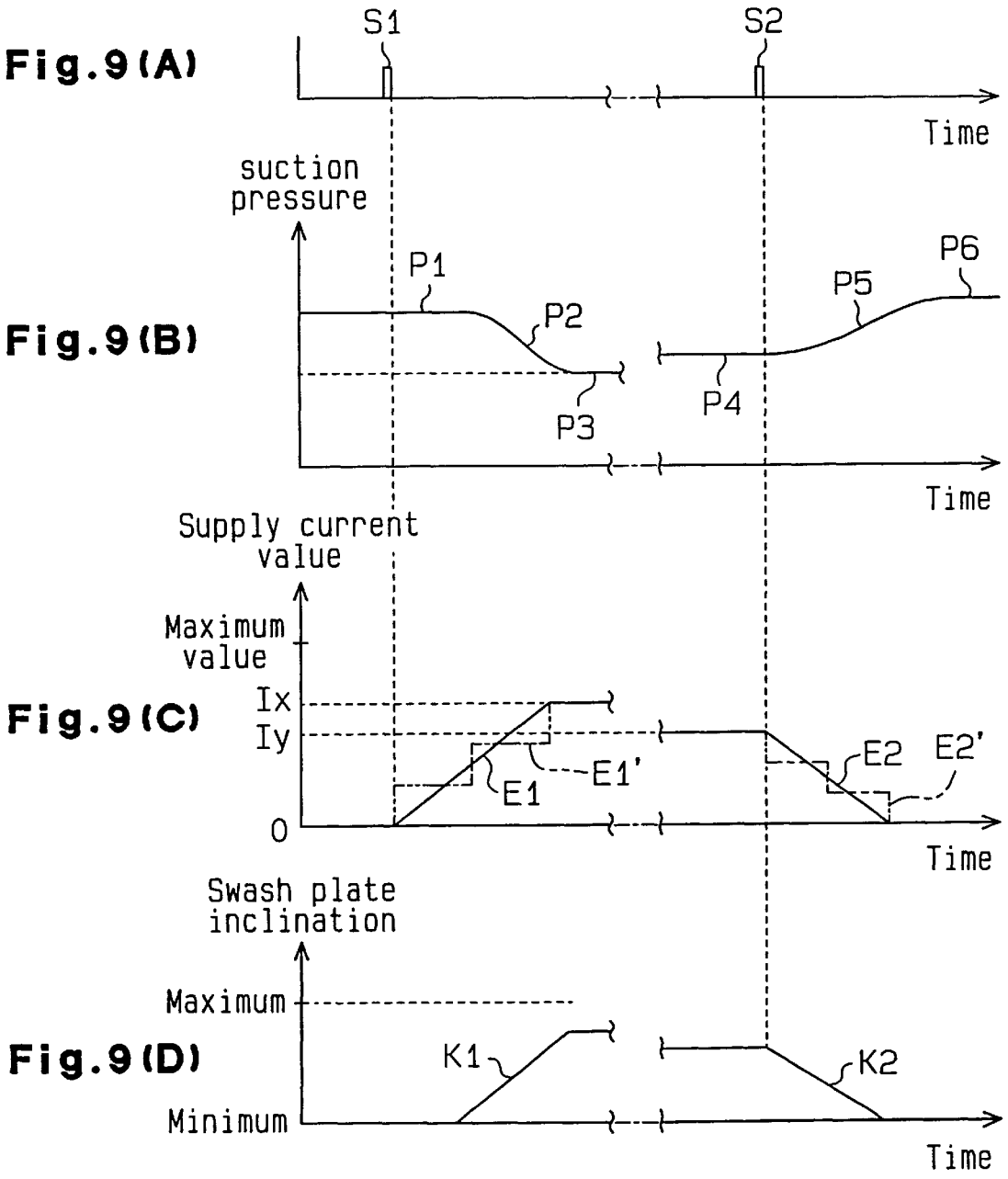
FIGS. 9(A) to 9(D) are graphs showing the value of current supplied to the control valve, the swash plate inclination and the suction pressure of the compressor shown in FIG. 7.

A method for controlling the control valve 46 will now be described with reference to FIGS. 9(A) to 9(D). When the air conditioner switch 80 is turned on, a signal S1 is sent to the controller C as shown in the graph of FIG. 9(A). The signal S1 causes the controller C to start supplying current to the control valve 46. Accordingly, the controller C compares the temperature detected by the compartment temperature sensor 81 and the target temperature set by the temperature adjuster 82 and determines a target value of the current supplied to the control valve 46 based on the temperature comparison.

The graph of FIG. 9(C) shows changes of current supplied to the control valve 46. A level Ix represents a target current value computed when the signal S1 is received by the controller C. The target current value is varied in accordance with the difference between the temperature detected by the compartment temperature sensor 81 and the temperature set by the temperature adjuster 82.

As illustrated by a line E1 of the graph of FIG. 9(C), the controller C gradually increases the current to the control valve 46 from zero to the target current value Ix in response to the input of the signal S1. Accordingly, the valve body 52 of the control valve 46 gradually decreases the opening amount of the valve hole 53, which gradually lowers the pressure in the crank chamber 15.

As the pressure in the crank chamber 15 is slowly lowered, the inclination of the swash plate 31 gradually increases from the minimum inclination as shown in a line K1 of the graph of FIG. 9(D). That is, the compressor displacement gradually increases from the minimum displacement. This starts circulation of refrigerant between the external refrigerant circuit 71 and the compressor and gradually lowers the suction pressure. In the graph of FIG. 9(B), a level line P1 shows a suction pressure before the air conditioner switch 80 is turned on. A line P2 shows the suction pressure that is being lowered as the inclination of the swash plate 31 increases.

When the supply current level reaches the target level Ix, the swash plate 31 is moved to a inclination position corresponding to the value Ix and the suction pressure seeks a value corresponding to the target current level Ix. A level line P3 in the graph of FIG. 9(B) shows a suction pressure corresponding to the target current value Ix.

When the air conditioner switch 80 is turned off, a signal S2 is sent to the controller C as shown in the graph of FIG. 9(A). The signal S2 causes the controller C to stop supplying current to the control valve 46. Accordingly, the controller C gradually decreases the supply current value from the target current value Iy at the time of input of the signal S2 to zero as shown in a line E2 of the graph of FIG. 9(C). Accordingly, the valve body 52 of the control valve 46 gradually increases the opening amount of the valve hole 53, which gradually increases the pressure in the crank chamber 15.

As the pressure in the crank chamber 15 is slowly raised, the inclination of the swash plate 31 gradually decreases from the inclination at the time of input of the signal S2. The swash plate inclination is decreased as shown by a line K2 of the graph of FIG. 9(D), which gradually decreases the compressor displacement. Accordingly, the suction pressure is gradually increased. In the graph of FIG. 9(B), a level line P4 shows a suction pressure before the air conditioner switch 80 is turned off. A line P5 shows the suction pressure that is being increased as the inclination of the swash plate 31 decreases.

When the supply current value is zero, the swash plate 31 moves to the minimum inclination position, which stops circulation of refrigerant gas between the external refrigerant circuit 71 and the compressor. A level line P6 in the graph of FIG. 9(B) shows the suction pressure after the refrigerant circulation is stopped.

The graphs of FIGS. 9(A) to 9(D) describe a case where the current to the control valve 46 is started and stopped in response to the signals S1, S2, which are produced based on manipulation of the air conditioner switch 80. The current to the control valve 46 is also started and stopped based on conditions other than the signals S1, S2. In these cases, the current supply is controlled in the same manner as shown in FIGS. 9(A) to 9(D). Also, not only when the current to the control valve 46 is started or stopped, but also when the target value of the current supplied to the control valve 46 is changed, the method of FIGS. 9(A) to 9(D) may be performed.

The embodiment of FIGS. 7 to 9 has substantially the same advantages as the embodiment of FIGS. 1 to 5. That is, when current supply to the control valve 46 is started, the supply current is gradually increased from zero to the target current value. Thus, the valve body 52 is gradually moved, which gradually increases the inclination of the swash plate 31. As a result, the swash plate 31 is not moved beyond an inclination position that corresponds to the target current value. Also, the swash plate 31 is prevented from violently collide with the rotor 30.

When the current to the control valve 46 is stopped, the current is gradually decreased from the target current value to zero, which slowly moves the valve body 52. Accordingly, the inclination of the swash plate 31 is gradually decreased. As a result, the shutter 75, which moves integrally with the swash plate 31, is prevented from violently colliding with the valve plate assembly 14.

The control valve 46 of the third embodiment does not require a mechanical damping device. Instead, the method for controlling the control valve 46 is changed. Thus, the third embodiment is relatively easy to implement at a relatively low cost.

The speed of the valve body 52 corresponds to the ratio of change of the current to the control valve 46. Therefore, unlike a mechanical damping device, the speed of the valve body 52 is therefore arbitrarily changed by the controller C. Thus, the ratio of change of the current to the control valve 46 may be optimized for the conditions (for example, the value of the target current) when starting or stopping supplying current to the control valve 46.

Also, when necessary, the value of supply current may be instantaneously increased from zero to a target current value or may be instantaneously decreased from a target current value to zero. This is effective when the compressor displacement needs to be instantaneously increased or decreased.

The vehicle electric system may be changed such that current can be supplied to the control valve 46 even if the engine Eg is not running. In this case, the supply current value to the control valve 46 may be gradually decreased even if the engine Eg is stopped.

The supply current value does not need to be changed in continuous manner. For example, the supply current value ay be changed discretely as shown by two-dot chain lines E1' and E2' in the graph of FIG. 9(C).

A fourth embodiment of the present invention will now be described with reference to FIGS. 10 and 11. The differences from the embodiment of FIGS. 7 to 9 will mainly be discussed below.

Figure 10:
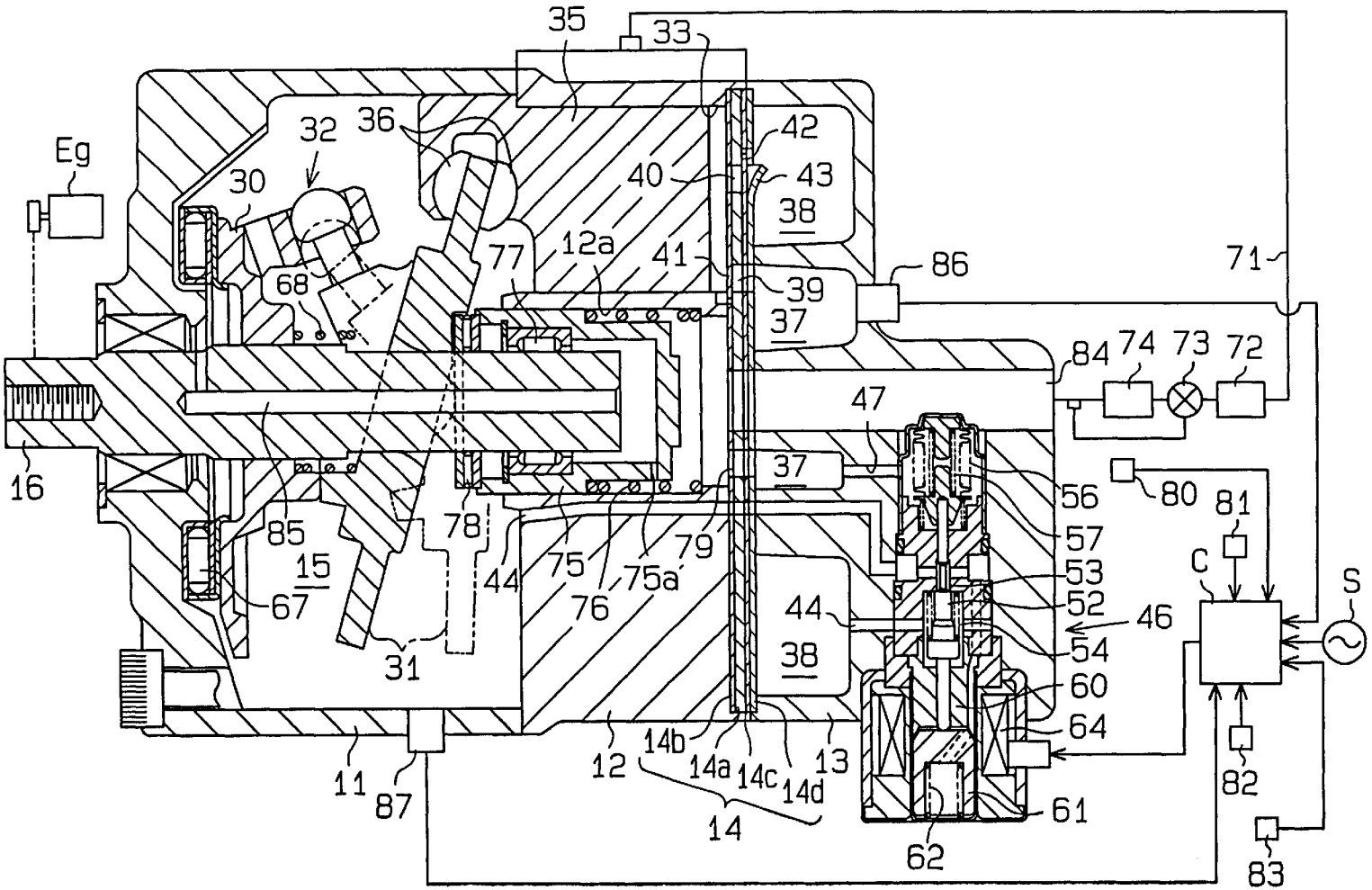
FIG. 10 is a cross-sectional view illustrating a compressor according to a fourth embodiment of the present invention.
Figure 11:
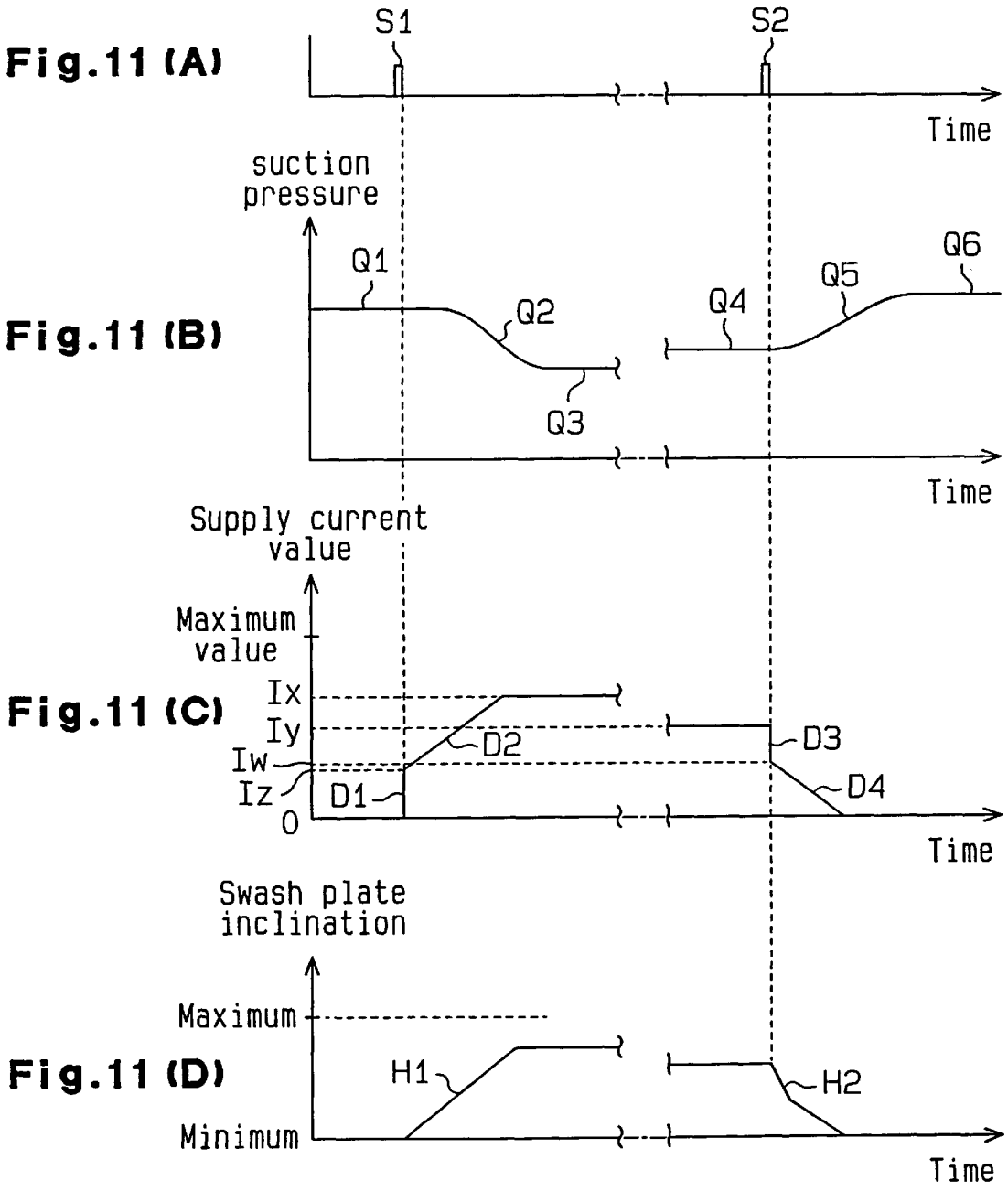
FIGS. 11(A) to 11(D) are graphs showing the value of current supplied to the control valve, the swash plate inclination and the suction pressure of the compressor shown in FIG. 10.

As shown in FIG. 10, the suction pressure in the suction chamber 37 is detected by a suction pressure sensor 86. The crank chamber pressure is detected by a crank chamber pressure sensor 87. The sensors 86, 87 send detection data to the controller C. The controller C stores first and second control maps (both are not shown). The suction pressure and the supply current value are used as variables in the first control map. The crank chamber pressure and the supply current value are used as variables in the second control map.

When staring supplying current to the control valve 46, the controller C controls the current based on the pressure data obtained by the suction pressure sensor 86 referring to the first control map. When stopping supplying current to the control valve 46, the controller C controls the current to the control valve 46 based on the pressure data obtained by the crank chamber pressure sensor 87 referring to the second control map.

A method for controlling the control valve 46 will now be described with reference to FIG. 11. When the air conditioner switch 80 is turned on, a signal S1 is sent to the controller C as shown in the graph of FIG. 11(A). The signal S1 causes the controller C to start supplying current to the control valve 46. Accordingly, the controller C compares the temperature detected by the compartment temperature sensor 81 and the target temperature set by the temperature adjuster 82 and determines a target value of the current supplied to the control valve 46 based on the temperature comparison. The determined target current value is defined as a value Ix as shown in the graph of FIG. 11(C).

The controller C also computes an instant increase current value Iz based on the target current value Ix and the suction pressure detected by the suction pressure sensor 86 referring to the first control map. The instant increase current value Iz is smaller than the target current value Ix. The instant increase current value Iz is an upper limit value to which the current supplied to the control valve 46 can be instantaneously increased when the controller C starts supplying current to the control valve 46.

The controller C instantaneously increases the supply current from zero the value Iz as illustrated by a line D1 in the graph of FIG. 11(C). Then, as illustrated by a line D2 of the graph of FIG. 11(C), the controller C gradually increases the current to the control valve 46 from the value Iz to the target current value Ix. Accordingly, the valve body 52 of the control valve 46 instantaneously decreases the opening amount of the valve hole 53 to an opening amount that corresponds to the value Iz. The valve body 52 then gradually decreases the opening amount of the valve hole 53 to an opening amount that corresponds to the value Ix. As the supply current value gradually increases from the value Iz to the value Ix, the pressure in the crank chamber 15 gradually decreases, accordingly.

As the pressure in the crank chamber 15 is slowly lowered, the inclination of the swash plate 31 gradually increases from the minimum inclination as shown in a line H1 of the graph of FIG. 11(D). That is, the compressor displacement gradually increases from the minimum displacement. This starts circulation of refrigerant between the external refrigerant circuit 71 and the compressor and gradually lowers the suction pressure. In the graph of FIG. 11(B), a level line Q1 shows a suction pressure before the air conditioner switch 80 is turned on. A line Q2 shows the suction pressure that is being lowered as the inclination of the swash plate 31 increases.

When the supply current value reaches the target current value Ix, the swash plate 31 is moved to an inclination position that corresponds to the target current value Ix, and the suction pressure seeks a value that corresponds to the target value Ix. A line Q3 in the graph of FIG. 11(B) shows a suction pressure that corresponds to the target current value Ix.

When the air conditioner switch 80 is turned off, a signal S2 is sent to the controller C as shown in the graph of FIG. 11(A). The signal S2 causes the controller C to stop supplying current to the control valve 46. The controller C also computes an instant decrease current value Iw based on the target current value Iy at the time of input of the signal S2 and the crank chamber pressure detected by the crank chamber pressure sensor 87 referring to the second control map. The instant decrease current value Iw is a lower limit value to which the current supplied to the control valve 46 can be instantaneously decreased when the controller C receives the signal S2.

The controller C instantaneously decreases the supply current from the target value Iy at the time of input of the signal S2 to the instant decrease value Iw. Then, as illustrated by a line D4 of the graph of FIG. 11(C), the controller C gradually decreases the current value from the value Iw to zero. First, the valve body 52 of the control valve 46 instantaneously increases the opening amount of the valve hole 53 to an opening amount that corresponds to the value Iw. The valve body 52 then gradually increases the opening amount of the valve hole 53. As the supply current value gradually decreases from the value Iw to zero, the crank chamber pressure gradually increases, accordingly.

As the crank chamber pressure slowly increases, the inclination of the swash plate 31 is gradually decreased from the inclination at the time of input of the signal S2 as shown by a line H2 in the graph of FIG. 11(D). Accordingly, the compressor displacement gradually decreases and the suction pressure gradually increases. In the graph of FIG. 11(B), a line Q4 shows the suction pressure before the air conditioner switch 80 is turned off, a line Q5 shows the suction pressure as the swash plate inclination slowly decreases.

When the supply current is stopped, the swash plate 31 is moved to the minimum inclination position, which stops circulation of refrigerant between the external refrigerant circuit 71 and the compressor. A line Q6 in the graph of FIG. 11(B) shows the suction pressure after the refrigerant circulation is stopped.

The graphs of FIGS. 11(A) to 11(D) describe a case where the current to the control valve 46 is started and stopped in response to the signals S1, S2, which are produced based on manipulation of the air conditioner switch 80. The current to the control valve 46 is also started and stopped based on conditions other than the signals S1, S2. In these cases, the current supply is controlled in the same manner as shown in FIGS. 11(A) to 11(D). Also, not only when the current to the control valve 46 is started or stopped, but also when the target value of the current supplied to the control valve 46 is changed, the method of FIGS. 11(A) to 11(D) may be performed.

In the fourth embodiment, when current supply to the control valve 46 is started, the instant increase current value Iz is computed based on the current target current value Ix and the suction pressure. Then, after the supply current is instantaneously increased to the value Iz from zero, the current is gradually increased to the target current value Ix. The instant increase value Iz is an upper limit value to which the current can be instantaneously increased without causing the swash plate 31 to collide with the rotor 30. The value Iz varies depending on the suction pressure. That is, if the supply current is instantaneously increased to a value that is higher than the value Iz, the swash plate 31 can collide with the rotor 30 and produce noise. Increasing the supply current to the instant increase value Iz quickly increases the swash plate inclination without producing noise and quickly increases the compressor displacement.

When the current to the control valve 46 is stopped, the instant decrease current value Iw is computed based on the current target current value Iy and the crank chamber pressure. Then, the supply current is instantaneously decreased from the target current value Iy to the value Iw. Thereafter, the supply current is gradually decreased to zero. The instant decrease value Iw is a minimum value to which the supply current can be instantaneously decreased without causing the shutter 75, which moves integrally with the swash plate 31, to collide with the valve plate assembly 14. The value Iw is changed depending on the crank chamber pressure. That is, if the supply current is instantaneously decreased to a value that is lower than the value Iw, the shutter 75 can collide with the valve plate assembly 14 and produce noise. Decreasing the supply current to the instant decrease value Iw quickly decreases the swash plate inclination without producing noise and quickly decreases the compressor displacement.

In this manner, the current to the control valve 46 is gradually changed only immediately before the swash plate 31 reaches a target inclination position. Therefore, the compressor is prevented from producing collision noise and the compressor displacement is quickly changed.

A fifth embodiment of the present invention will now be described with reference to FIGS. 12 and 13. The differences from the embodiment of FIGS. 7 to 9 will mainly be discussed below.

Figure 12:
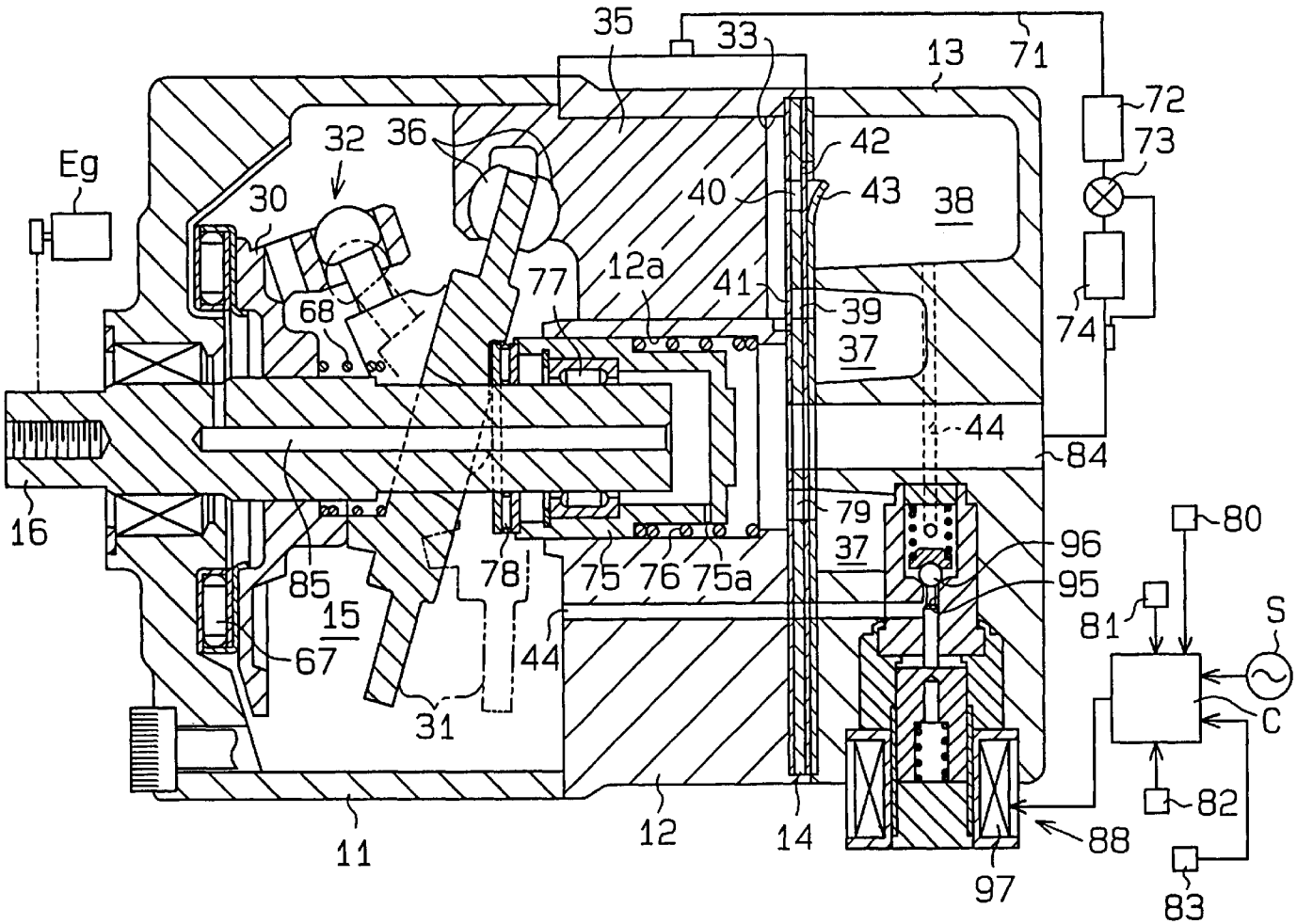
FIG. 12 is a cross-sectional view illustrating a compressor according to a fifth embodiment of the present invention.

As shown in FIG. 12, a compressor of the fifth embodiment has a control valve 88 that is different from the control valve 46 of FIG. 7. Specifically, the control valve 88 does not have a pressure sensing mechanism, which moves a valve body in accordance with the suction pressure. The control valve 88 operates in accordance with electric current from the outside. The compressor of the fifth embodiment is the same as the compressor of FIG. 7 except for the control valve 88.

The electromagnetic control valve 88 includes a valve hole 95, a valve body 96 that faces the valve hole 95 and an electromagnetic actuator for moving the valve body 96. The actuator is a solenoid 97 in this embodiment. When the solenoid 97 is excited, the valve body 96 closes the valve hole 95, which moves the swash plate 31 to the maximum inclination position. When the solenoid 97 is de-excited, the valve body 96 maximizes the opening amount of the valve hole 95, which moves the swash plate 31 to the minimum inclination position.

When the air conditioner switch 80 is turned off, the controller C de-excites the solenoid 97. When the air conditioner switch 80 is on, the controller C excites the solenoid 97 if the temperature detected by the compartment temperature sensor 81 is greater than a target temperature set by the temperature adjuster 82. When the temperature detected by the sensor 81 is lower than the temperature set by the temperature adjuster 82, the controller C de-excites the solenoid 97. When the solenoid 97 is excited, the controller C de-excites the solenoid 97 for a predetermined period if the vehicle is rapidly accelerated, that is, if the acceleration pedal depression amount detected by the acceleration pedal sensor 83 is greater than a predetermined value.

A method for controlling the control valve 88 will now be described with reference to FIG. 13. When exciting the solenoid 97, the controller C gradually increases the current supplied to the solenoid 97 as shown by a line F1 in the graph of FIG. 13(C). The maximum value of the current corresponds to the target current value. A signal S3 in the graph of FIG. 13(A) represents a command to start supplying current to the solenoid 97. A line G1 in the graph of FIG. 13(D) shows an increase of the swash plate inclination in accordance with the increase of the supply current. A line R1 in the graph of FIG. 13(B) shows an increase of the suction pressure in accordance with the increase of the swash plate inclination.

Figures 13A, 13B, 13C, 13D:
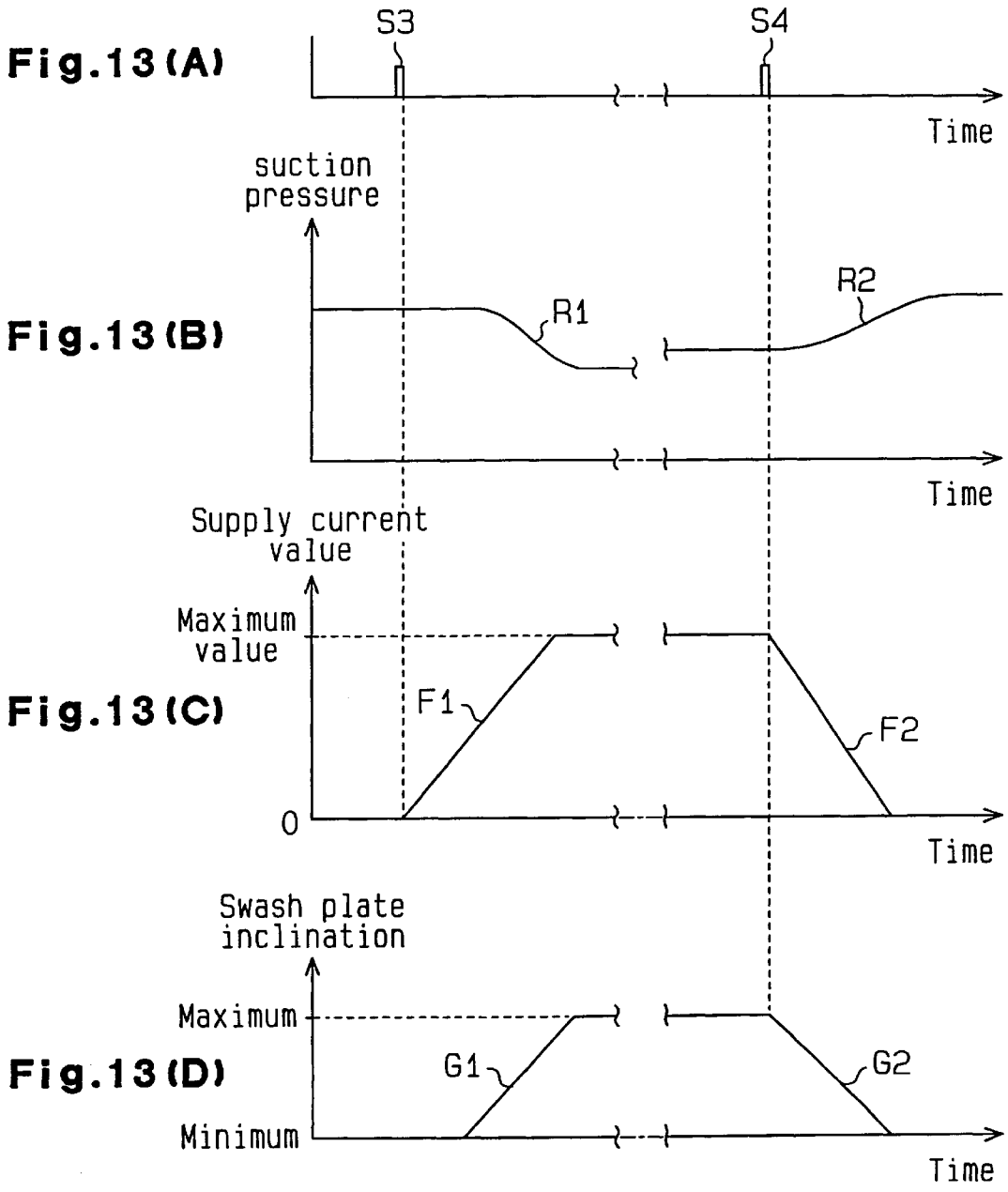
FIGS. 13(A) to 13(D) are graphs showing the value of current supplied to the control valve, the swash plate inclination and the suction pressure of the compressor shown in FIG. 12.
Figure 14:
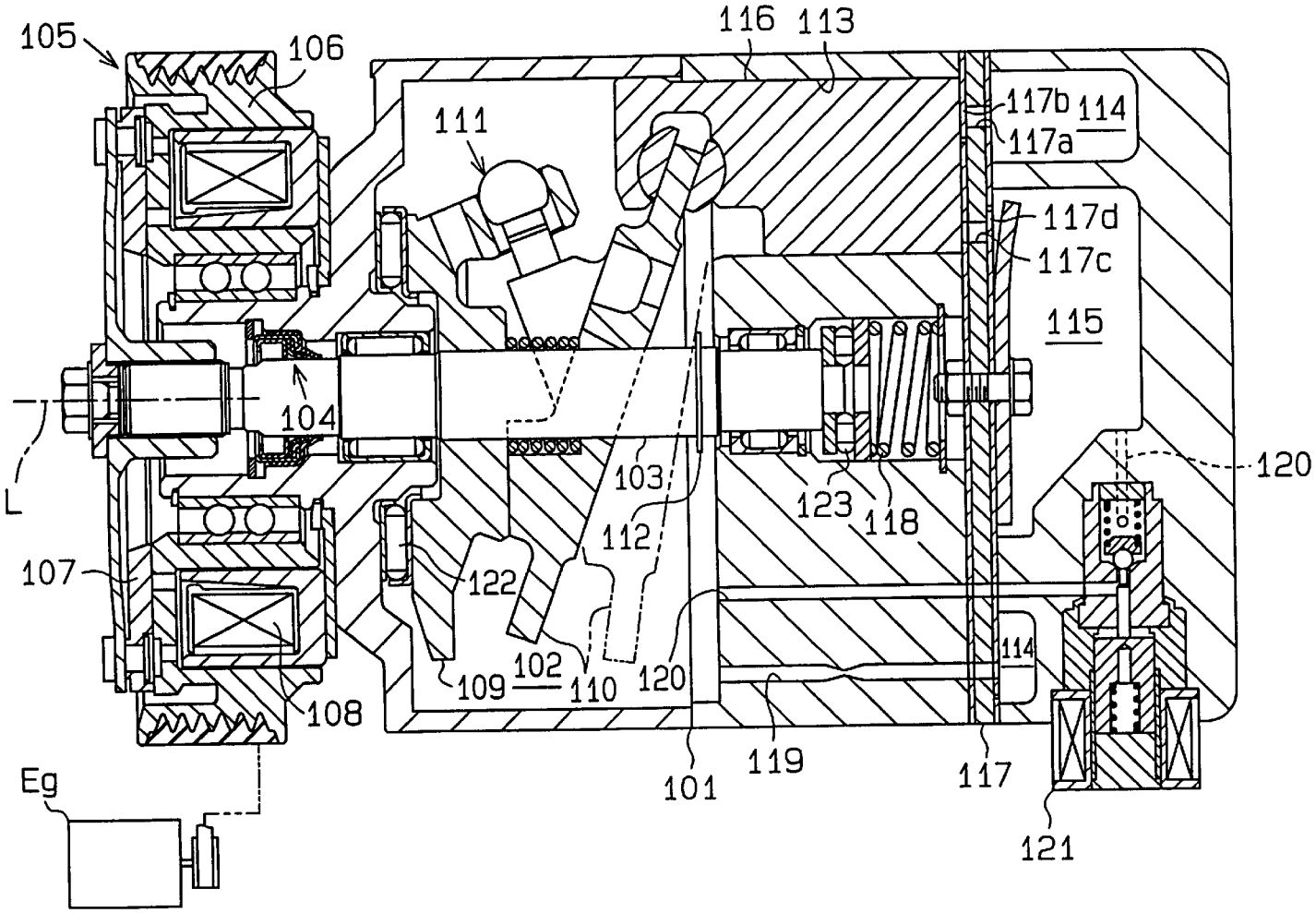
Fig.14 (Prior Art)
FIG. 14 is a cross-sectional view illustrating a prior art compressor.

When de-exciting the solenoid 97, the controller C gradually decreases the current supplied to the solenoid 97 as shown by a line F2 in the graph of FIG. 13(C). A signal S4 in the graph of FIG. 13(A) represents a command to stop supplying current to the solenoid 97. A line G2 in the graph of FIG. 13(D) shows a decrease of the swash plate inclination in accordance with the decrease of the supply current.

A line R2 in the graph of FIG. 13(B) shows a decrease of the suction pressure in accordance with the decrease of the swash plate inclination.

When the swash plate inclination is increased, the sliding speed of the swash plate 31 is reduced to prevent the swash plate 31 from colliding with the rotor 30. Also, when the swash plate inclination decreases, the sliding speed of the swash plate 31 is reduced to prevent the shutter 75 from colliding with the valve plate assembly 14.

The supply current value may be changed discretely as shown by two-dot chain lines E1' and E2' in the graph of FIG. 9(C). Alternatively, the control valve 88 may be controlled by the method of the embodiment of FIGS. 10 and 11.

It should be apparent to those skilled in the art that the present invention may be embodied in many other specific forms without departing from the spirit or scope of the invention. More particularly, the present invention may be modified as described below.

In the embodiments of FIGS. 7 to 11, the current to the control valve may be gradually changed only when the swash plate 31 is moved from the minimum inclination position to the maximum inclination position. Alternatively, the current to the control valve may be gradually changed only when the swash plate 31 is moved from the maximum inclination position to the minimum inclination position. In this manner, the compressor displacement can be quickly changed when the parts of the compressor do not collide with each other or when the drive shaft 16 does not move axially.

In the embodiment of FIGS. 7 to 9, current value supplied to the control valve 46 may be gradually increased to a value that is greater than a target value and then be gradually decreased to the target value. This prevents the swash plate 31 from moving too fast only in the vicinity of the target inclination position and the compressor displacement is quickly increased.

In the embodiments of FIGS. 7 to 13, current to the control valve 46 may be controlled by a duty cycle. In this case, the average of the current value per unit time is defined as the supply current value.

In the embodiments of FIGS. 1 to 11, the pressure sensing mechanism, which includes the bellows 56, may be omitted from the control valve 46.

The control valve 88 of FIG. 12 may include the damping device of the control valve 46 of FIG. 2.

The clutch 23 may be omitted from the compressor of FIG. 1. The compressor of FIG. 1 may include the shutter 75 of FIG. 7. Alternatively, the clutch 23 of FIG. 1 may be used in the compressors of FIGS. 7, 10 and 12. The shutter 75 may be omitted from the compressor of FIGS. 7, 10 and 12.

In addition to or instead of the control valve located in the supply passage 44, a control valve may be located in the bleeding passage, which connects the crank chamber 15 to the suction chamber 37.

The present invention may be embodied in any type of compressor as long as it includes a displacement control valve. For example, the present invention may be embodied in wobble plate type compressors. A wobble plate type compressor includes pistons. Each piston includes a rod that is connected to a wobble plate. As a drive shaft rotates, the wobble plate wobbles without being rotated.

The present examples and embodiments are to be considered as illustrative and not restrictive and the invention is not to be limited to the details given herein, but may be modified within the scope and equivalence of the appended claims.

What is claimed is:

1. A compressor comprising:

a housing;

a cylinder bore formed in the housing;

a control pressure chamber defined in the housing;

a piston housed in the cylinder bore, wherein the piston compresses gas drawn into the cylinder bore and discharges the gas from the cylinder bore;

a drive shaft rotatably supported by the housing;

a drive plate operably coupled to the piston to convert rotation of the drive shaft into reciprocation of the piston, wherein the drive plate is supported by the drive shaft to incline relative to the drive shaft, and is moved between a maximum inclination position and a minimum inclination position in accordance with the pressure in the control pressure chamber, wherein the inclination of the drive plate defines the stroke of the piston and the displacement of the compressor;

a control valve, wherein the control valve controls the pressure in the control pressure chamber to change the inclination of the drive plate, and wherein the control valve is actuated based on an electrical signal; and a damping device for decreasing the speed of operation of the control valve.

2. The compressor according to claim 1, wherein the control valve includes a valve body and an electromagnetic actuator for moving the valve body, and wherein the damping device is located in the control valve to apply resistance to the valve body.

3. The compressor according to claim 2, wherein the damping device comprises a fluid damper that applies fluid resistance to the valve body.

4. The compressor according to claim 3, wherein the fluid damper comprises:

a damper chamber defined in the control valve, wherein fluid is sealed in the damper chamber; and a pressure receiver located in the damper chamber, wherein the pressure receiver is integrally moved with the valve body, and wherein, when moving, the pressure receiver receives resistance of the fluid.

5. The compressor according to claim 4, wherein the electromagnetic actuator includes a fixed core, a plunger movable relative to the fixed core, a plunger chamber to accommodate the plunger and a coil located about the fixed core and the plunger, wherein, when the coil receives electric current, electromagnetic force is generated between the fixed core and the plunger, and wherein the plunger chamber being used as the damper chamber and the plunger functions as the pressure receiver.

6. The compressor according to claim 1, wherein the control valve includes a valve body and an electromagnetic actuator for moving the valve body, wherein the damping device comprises a controller that controls current supplied to the electromagnetic actuator, the controller controlling movement of the valve body in accordance with current supplied to the electromagnetic actuator, and wherein, when the value of current supplied to the electromagnetic actuator is changed from a first value to a second value, the controller gradually changes the value of the current in at least a part of the range between the first value and the second value.

7. The compressor according to claim 6, wherein the controller continuously changes the value of current supplied to the electromagnetic actuator.

8. The compressor according to claim 6, wherein the controller discretely changes the value of current supplied to the electromagnetic actuator.

9. The compressor according to claim 6, wherein one of the first and second values is zero and the other is greater than zero.

10. The compressor according to claim 6, wherein one of the first and second values is a value for moving the drive plate to the minimum inclination position, and the other is a value for moving the drive plate to the maximum inclination position.

11. The compressor according to claim 6, wherein the controller computes an instant change current value, which is between the first and second values, and wherein the controller first instantaneously changes the current value from the fist value to the instant change current value and then gradually changes the current value from the instant change current value to the second value.

12. The compressor according to claim 11, further comprising a suction chamber filled with gas, the gas being drawn into the cylinder bore, wherein, when the fist value is zero and the second value is greater than zero, the controller computes the instant change current value based on the second value and the pressure in the suction chamber.

13. The compressor according to claim 11, wherein, when the second value is zero and the first value is greater than zero, the controller computes the instant change current value based on the first value and the pressure in the control pressure chamber.

14. The compressor according to claim 1, further comprising:

a discharge chamber defined in the housing, wherein the discharge chamber is filled with gas discharged from the cylinder bore; and a supply passage for connecting the control pressure chamber to the discharge chamber, wherein the control valve is located in the supply passage to control the amount of gas supplied from the discharge chamber to the control pressure chamber.

15. A compressor comprising:

a housing;

a cylinder bore formed in the housing;

a control pressure chamber defined in the housing;

a piston housed in the cylinder bore, wherein the piston compresses gas drawn into the cylinder bore and discharges the gas from the cylinder bore;

a drive shaft rotatably supported by the housing;

a drive plate operably coupled to the piston to convert rotation of the drive shaft into reciprocation of the piston, wherein the drive plate is supported by the drive shaft to incline relative to the drive shaft, and is moved between a maximum inclination position and a minimum inclination position in accordance with the pressure in the control pressure chamber, wherein the inclination of the drive plate defines the stroke of the piston and the displacement of the compressor;

a control valve, wherein the control valve controls the pressure in the control pressure chamber to change the inclination of the drive plate, and wherein the control valve includes a valve body and an electromagnetic actuator for moving the valve body; and means for controlling current supplied to the electromagnetic actuator, wherein the controlling means controls movement of the valve body in accordance with current supplied to the electromagnetic actuator, and wherein the controlling means controls current supplied to the electromagnetic actuator to decrease the inclining speed of the drive plate at least immediately before the drive plate reaches the minimum inclination position or immediately before the drive plate reaches the maximum inclination position.

16. A method for controlling the displacement of a variable displacement compressor, wherein the compressor includes a drive plate that moves between a maximum inclination position and a minimum inclination position in accordance with the pressure in a control pressure chamber, the inclination of the drive plate defining the displacement of the compressor, the method comprising:

controlling the pressure in the control pressure chamber by a control valve to change the inclination of the drive plate, wherein the control valve includes a valve body and an electromagnetic actuator for moving the valve body;

controlling current supplied to the electromagnetic actuator, wherein movement of the valve body is controlled in accordance with current supplied to the electromagnetic actuator; and preventing the valve body from being suddenly moved, wherein, when the value of current supplied to the electromagnetic actuator is changed from a first value to a second value, sudden movement of the valve body is prevented by gradually changing the value of the current in at least a part of the range between a first value and a second value.

17. The method according to claim 16, wherein the value of current supplied to the electromagnetic actuator is changed continuously.

18. The method according to claim 16, wherein the value of current supplied to the electromagnetic actuator is changed discretely.

19. The method according to claim 16, further including:

computing an instant change current value, wherein the instant change current value is between the first and second values;

instantaneously changing the value of current from the first value to the instant change current value; and gradually changing the value of current from the instant current value to the second value after the current value is instantaneously changed.

20. The method according to claim 19, wherein, when the fist value is zero and the second value is greater than zero, the instant change current value is computed based on the second value and the pressure of gas to be drawn into the cylinder bore.

21. The method according to claim 19, wherein, when the second value is zero and the first value is greater than zero, the instant change current value is computed based on the first value and the pressure in the control pressure chamber.

* * * * *

UNITED STATES PATENT AND TRADEMARK OFFICE

CERTIFICATE OF CORRECTION

PATENT NO. : 6,224,348 B1
DATED : May 1, 2001
INVENTOR(S) : Tetsuhiko Fukanuma et al.

It is certified that error appears in the above-identified patent and that said Letters Patent is hereby corrected as shown below:

Column 15,
Line 42, please change "ay be changed" to -- may be changed --.

Signed and Sealed this

Twenty-third Day of April, 2002

*Attest:*

*Attesting Officer*

JAMES E. ROGAN
*Director of the United States Patent and Trademark Office*